US006570342B2

(12) United States Patent
Okubo et al.

(10) Patent No.: US 6,570,342 B2
(45) Date of Patent: May 27, 2003

(54) FLUORESCENT LAMP AND POWER CONVERTER

(75) Inventors: Kazuaki Okubo, Takatsuki (JP); Yoshinori Tanabe, Hirakata (JP); Masanori Shimizu, Kyotanabe (JP); Takeshi Arakawa, Kyoto (JP); Yoko Shimomura, Ikoma (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/874,945

(22) Filed: Jun. 5, 2001

(65) Prior Publication Data

US 2002/0067137 A1 Jun. 6, 2002

(30) Foreign Application Priority Data

Oct. 3, 2000 (JP) ..... 2000-303339
Mar. 5, 2001 (JP) ..... 2001-060987

(51) Int. Cl.[7] ..... H01J 23/34

(52) U.S. Cl. ..... 315/209 R; 315/58; 315/128; 315/159; 315/224; 315/307; 315/360; 315/362

(58) Field of Search ..... 315/209 R, 128, 315/159, 224, 225, 291, 299, 307, 360, DIG. 2, DIG. 5, 240, 246, 362, 58

(56) References Cited

U.S. PATENT DOCUMENTS 4,758,173 A * 7/1988 Northrop ..... 439/232
4,937,505 A * 6/1990 Deglon et al. ..... 315/205
5,384,516 A * 1/1995 Kawabata et al. ..... 315/160

* cited by examiner

*Primary Examiner*—Don Wong
*Assistant Examiner*—Thuy Vinh Tran
(74) *Attorney, Agent, or Firm*—Renner, Otto, Boisselle & Sklar

(57) ABSTRACT

A fluorescent lamp includes: an emission tube for generating a luminous flux; a first filament provided at one end of the emission tube; a second filament provided at another end of the emission tube; first current regulator having a first impedance; a first electrode pin coupled to one end of the first filament via the first current regulator; a first switch coupled in parallel to the first current regulator; a second switch; a second electrode pin coupled to another end of the first filament via the second switch; and a control circuit for controlling the first switch and the second switch so as to be opened or closed. The control circuit doses the first switch and the second switch before the fluorescent lamp is lit and during a nominal lighting period after the fluorescent lamp is lit, and opens the first switch and the second switch during a power conservation lighting period following the nominal lighting period.

9 Claims, 27 Drawing Sheets

Changes in lamp current and preheating current over time
(in the case resonance type lighting circuit)

① Power converter is mounted to illumination device

② Fluorescent lamp is mounted

FLUORESCENT LAMP AND POWER CONVERTER

BACKGROUND OF THE INVENTION

1. Field of the Invention

The present invention relates to a power-conserving type fluorescent lamp. The present invention also relates to a power converter which may be coupled to a fluorescent lamp or a fluorescent lamp illumination device so as to allow the fluorescent lamp to be lit with a relatively small amount of power.

2. Description of the Related Art

In recent years, from the perspective of global warming and maximization of utility of energy resources, great efforts have been made to realize energy conservation in various fields. In the field of illumination devices incorporating fluorescent lamps, attempts have been made to reduce power consumption by employing inverter electronic circuitry for lighting circuits used in illumination devices. However, illumination devices incorporating a magnetic ballast (choke coil) are still in wide use because they are inexpensive. In particular, rapid-start type fluorescent lamp illumination devices incorporating a magnetic ballast are frequently used in public facilities such as schools or gymnasiums, offices, warehouses, or factories. However, since such illumination devices do not have a light regulation function, there is a problem in that it is impossible to control power consumption by regulating the brightness according to each particular need.

Therefore, there has been a need for a fluorescent lamp which can be mounted in an illumination device incorporating a magnetic ballast, and yet is capable of being lit with a relatively low power consumption.

A rapid-start type fluorescent lamp is a type of fluorescent lamp in which a preheating current always flows through a filament of the lamp while the illumination device is on. A rapid-start type fluorescent lamp utilizes a preheating current which flows through the filament of the fluorescent lamp so as to lower a discharge initiation voltage of the lamp, so that the lamp can be immediately activated after being turned on. As a result, glow starters or the like are not employed in such illumination devices.

In a rapid-start type fluorescent lamp, electrode pins of the fluorescent lamp are coupled to both a preheating circuit and a lighting circuit which supplies a lamp current. Therefore, any resistors and/or capacitors which are inserted between the electrode pins and the filament for regulating the lamp current may act to lower the preheating current as well as the lamp current. As a result, it becomes difficult to obtain the level of preheating required for activation, preventing the fluorescent lamp from being activated.

A technique for lighting a rapid-start type fluorescent lamp with a relatively small amount of power is disclosed in U.S. Pat. No. 4,435,670. According to this conventional technique, after the fluorescent lamp is activated, the heat generated in the fluorescent lamp is detected with a thermistor, upon which the preheating circuit of the fluorescent lamp is isolated, and a lamp current is routed so as to be supplied to fluorescent lamp via a capacitor. As a result, the lamp current while the fluorescent lamp is lit is reduced by the use of the capacitor. However, this conventional technique has a problem in that once the fluorescent lamp is turned off, the fluorescent lamp cannot be lit if turned on immediately after being turned off. This is because it takes some time for the temperature of the lamp to be sufficiently lowered after the fluorescent lamp is turned off; during this period, the preheating circuit of the lamp remains isolated, preventing the lamp from being lit.

A technique for lighting a rapid-start type fluorescent lamp with a relatively low power consumption, which does not involve interrupting a preheating current, is known from U.S. Pat. Nos. 3,954,316 and 4,163,176 (hereinafter referred to as the "Sylvania method).

FIG. 26 is a diagram illustrating the principles by which a fluorescent lamp can be lit with a relatively low power consumption according to the Sylvania method. As shown in FIG. 26, according to the Sylvania method, a preheating power source 201 and a filament 202 are coupled via a transformer 203. A preheating current and a lamp current are separated, so that only the lamp current is reduced by a current regulation capacitor 206. As a result, the fluorescent lamp can be lit with a relatively low power consumption.

According to the Sylvania method, a large amount of copper and ion materials are used for the transformer 203, resulting in a large mass and volume thereof. In the case where a fluorescent lamp is mounted in a conventional illumination device, it is necessary to satisfy an inter-electrode distance (or the "full length" of the lamp) defined under the relevant standards. Incorporating such a large-volume transformer in a fluorescent lamp is not practical because the length of an emission tube will be significantly sacrificed. Moreover, according to the Sylvania method, the preheating current during the ON-period of the fluorescent lamp cannot be reduced. Thus, although capable of realizing a fluorescent lamp which requires a relatively low power consumption, the Sylvania method has problems associated with resource and energy conservation.

The lighting circuit for a rapid-start type fluorescent lamp incorporating a magnetic ballast can be generally classified into resonance type lighting circuits and lead-peak type lighting circuits. There is a problem in that while the aforementioned Sylvania method can be used for the lead-peak type lighting circuit, it cannot not be used for the resonance type lighting circuit.

SUMMARY OF THE INVENTION

In one aspect of the invention, there is provided a fluorescent lamp including: an emission tube for generating a luminous flux; a first filament provided at one end of the emission tube; a second filament provided at another end of the emission tube; first current regulation means having a first impedance: a first electrode pin coupled to one end of the first filament via the first current regulation means; a first switch coupled in parallel to the first current regulation means; a second switch; a second electrode pin coupled to another end of the first filament via the second switch; and a control circuit for controlling the first switch and the second switch so as to be opened or closed, wherein the control circuit closes the first switch and the second switch before the fluorescent lamp is lit and during a nominal lighting period after the fluorescent lamp is lit, and opens the first switch and the second switch during a power conservation lighting period following the nominal lighting period.

In one embodiment of the invention, the control circuit opens the first switch and the second switch after a predetermined period has elapsed since a current flows between the first electrode pin and the second electrode pin.

In another embodiment of the invention, the control circuit includes luminous flux detection means for detecting the luminous flux; and the control circuit opens the first switch and the second switch when the luminous flux detected by the luminous flux detection means exceeds a predetermined value.

In still another embodiment of the invention, the first current regulation means includes at least one element selected from the group consisting of a capacitor, a resistor, a coil and a thyristor.

In still another embodiment of the invention, the fluorescent lamp further includes display means for displaying whether or not the fluorescent lamp is operating in a power-conservation lighting mode.

In still another embodiment of the invention, the fluorescent lamp further includes second current regulation means having a second impedance, and a third switch coupled in parallel to the second current regulation means; the control circuit is coupled to the first electrode pin via the second current regulation means; and the control circuit opens the third switch during the power conservation lighting period.

Alternatively, a fluorescent lamp according to the present invention includes: an emission tube for generating a luminous flux; a first filament provided at one end of the emission tube; a second filament provided at another end of the emission tube; first current regulation means having a first impedance; a first electrode pin coupled to one end of the first filament via the first current regulation means; a first switch coupled in parallel to the first current regulation means; a second switch; a second electrode pin coupled to another end of the first filament via the second switch; and a control circuit for controlling the first switch and the second switch so as to be opened or closed, wherein the control circuit closes the first switch and the second switch before the fluorescent lamp is lit and during a nominal lighting period after the fluorescent lamp is lit, and is adapted so as to be capable of switching the first switch and the second switch so as to be both opened or closed during a power conservation lighting period following the nominal lighting period.

In another aspect of the present invention, there is provided a power converter which includes: a first electrode pin and a second electrode pin which are adapted so as to be capable of being electrically connected to two electrical contacts of a socket of a rapid-start type fluorescent lamp illumination device; a first electrical contact and a second electrical contact which are adapted so as to be capable of being electrically connected to two electrode pins of a filament of a fluorescent lamp to be mounted to the fluorescent lamp illumination device; current regulation means having an impedance and coupled between the first electrode pin and the first electrical contact; a first switch coupled in parallel to the current regulation means; a second switch coupled between the second electrode pin and the second electrical contact; and a control circuit for controlling the first switch and the second switch so as to be opened or closed, wherein the control circuit closes the first switch and the second switch before the fluorescent lamp is lit and during a nominal lighting period after the fluorescent lamp is lit, and opens the first switch and the second switch during a power conservation lighting period following the nominal lighting period.

Alternatively, a power converter according to the present invention includes: a first input terminal and a second input terminal which are adapted so as to be capable of being electrically connected to two wires extending from a lighting circuit to a socket in a rapid-start type fluorescent lamp illumination device for lighting a fluorescent lamp; a first output terminal and a second output terminal which are adapted so as to be capable of being electrically connected to two wires in electrical connection with electrical contacts of the socket; current regulation means having an impedance and coupled between the first input terminal and the first output terminal; a first switch coupled in parallel to the current regulation means; a second switch coupled between the second input terminal and the second output terminal; and a control circuit for controlling the first switch and the second switch so as to be opened or closed, wherein the control circuit closes the first switch and the second switch before the fluorescent lamp is lit and during a nominal lighting period after the fluorescent lamp is lit, and opens the first switch and the second switch during a power conservation lighting period following the nominal lighting period.

Thus, the invention described herein makes possible the advantages of (1) providing a power-conserving type fluorescent lamp to be used in conjunction with an illumination device incorporating a lead-peak type lighting circuit, such that a reduction in the power consumption can be achieved by simply replacing a conventional fluorescent lamp with the power-conserving type fluorescent lamp according to the present invention; (2) providing a power-conserving type fluorescent lamp which can be adapted to both a resonance type lighting circuit and a lead-peak type lighting circuit, such that a reduction in the power consumption can be achieved by simply replacing a conventional fluorescent lamp with the power-conserving type fluorescent lamp according to the present invention; and (3) providing a power converter which can be easily mounted to an illumination device or a conventional fluorescent lamp incorporating a rapid-start type ballast (a lead-peak type lighting circuit or a resonance type lighting circuit), whereby the power consumption of the fluorescent lamp can be reduced.

These and other advantages of the present invention will become apparent to those skilled in the art upon reading and understanding the following detailed description with reference to the accompanying figures.

DESCRIPTION OF THE PREFERRED EMBODIMENTS

First, a lighting circuit which is used for an illumination device for lighting a rapid-start type fluorescent lamp will be described.

Figure 1A:
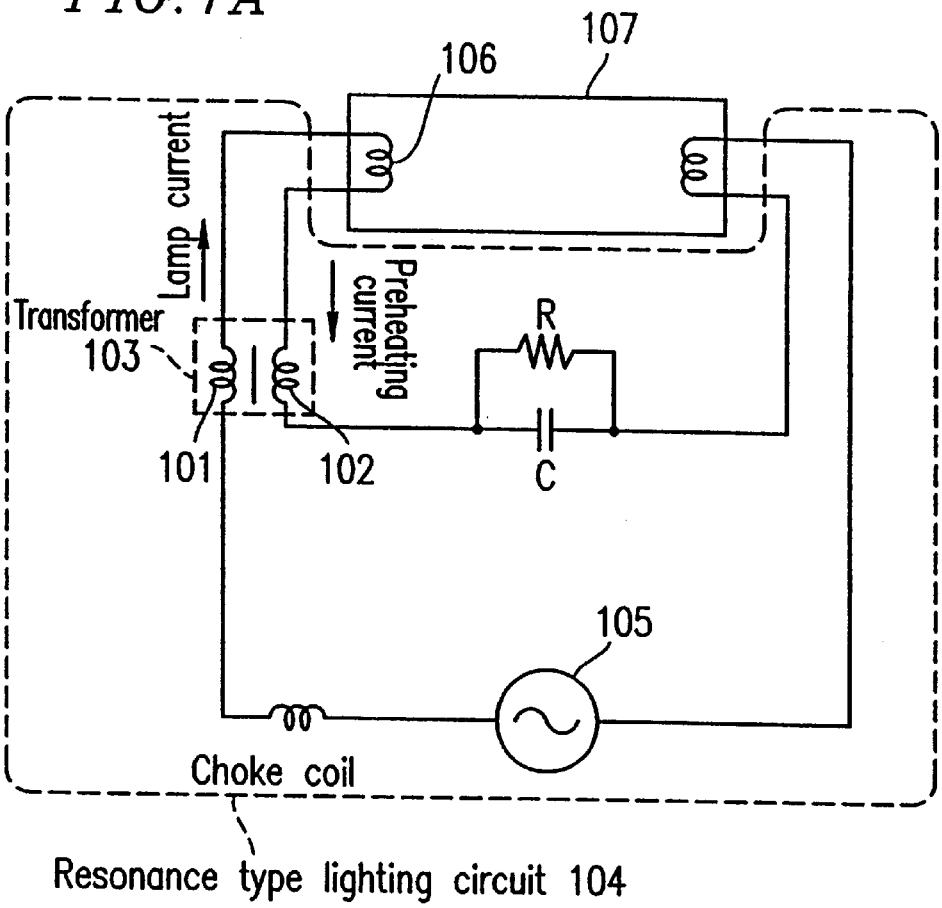
FIG. 1A is a circuit diagram of a resonance type lighting circuit 104.

FIG. 1A is a circuit diagram of a resonance type lighting circuit 104. The resonance type lighting circuit 104 is a lighting circuit for lighting a fluorescent lamp 107. The fluorescent lamp 107 may be, for example, a rapid-start type fluorescent lamp FLR40S/M-X.

The resonance type lighting circuit 104 includes a transformer 103. The transformer 103 combines a primary coil 101 for supplying a current from a power source 105 (e.g., a 200 V AC power source) to a filament 106, and a secondary coil 102 for supplying a preheating current. The wire composing the coil 101 and the wire composing the coil 102 are wound in opposite directions. During a lamp start period before the discharging of the fluorescent lamp 107 begins, a current flowing on the primary side of the transformer 103 and a current (preheating current) flowing on the secondary side are identical. Therefore, the current flowing through the primary coil 101 and the secondary coil 102 flow in such a manner as to cancel a magnetic field which is generated in each coil, so that the impedances of the coil 101 and the coil 102 decrease. As a result, during a lamp start period, a substantial preheating current flows to the filament 106 to facilitate the starting of the fluorescent lamp 107.

Once the fluorescent lamp 107 is started, the lamp current and the preheating current flow in the primary coil 101, whereas only the preheating current flows in the secondary coil 102. As a result, an impedance which corresponds to the lamp current (i.e., a difference between the current(s) flowing in the coil 101 and the coil 102) is generated at the coil 101 and the coil 102. Consequently, the lamp current assumes a nominal value. The preheating current takes a constant value.

In the resonance type lighting circuit 104, if a resistor (or a capacitor) is inserted in series to the coil 101 in order to reduce the lamp current during the ON-period of the fluorescent lamp 107, for example, the impedance of the primary coil 101 is decreased so that the lamp current is maintained at a constant value (i.e., the nominal current value). On the other hand, if the preheating current is reduced, the impedance of the primary side of the transformer 103 is increased, so that the lamp current is also decreased.

Figure 1B:
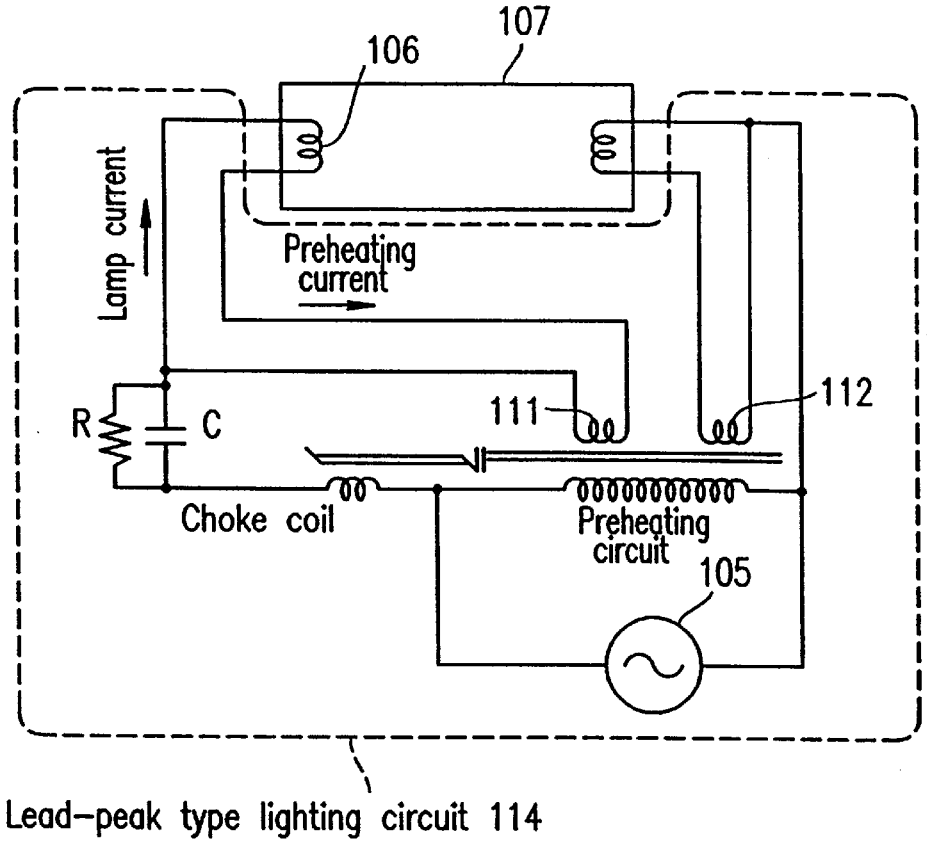
FIG. 1B is a circuit diagram of a lead-peak type lighting circuit 114.

FIG. 1B is a circuit diagram of a lead-peak type lighting circuit 114. In FIG. 1B, constituent elements which also appear in FIG. 1A are denoted by the same reference numerals as those used therein, and the associated description is omitted. In the lead-peak type lighting circuit 114, a preheating current flows due to voltages generated in coils 111 and 112, which are independent from a lamp current circuit. As a result, in accordance with the lead-peak type lighting circuit 114, the lamp current undergoes substantially no change even when the preheating current is regulated.

Thus, the mechanism for reducing the lamp current is different between the resonance type lighting circuit 104 and the lead-peak type lighting circuit 114.

Hereinafter, the present invention will be described by way of illustrative examples, with reference to the accompanying figures.

EXAMPLE 1

As Example 1 of the present invention, a fluorescent lamp according to the present invention which can be used in conjunction with a lead-peak type lighting circuit will be described.

Figure 2:
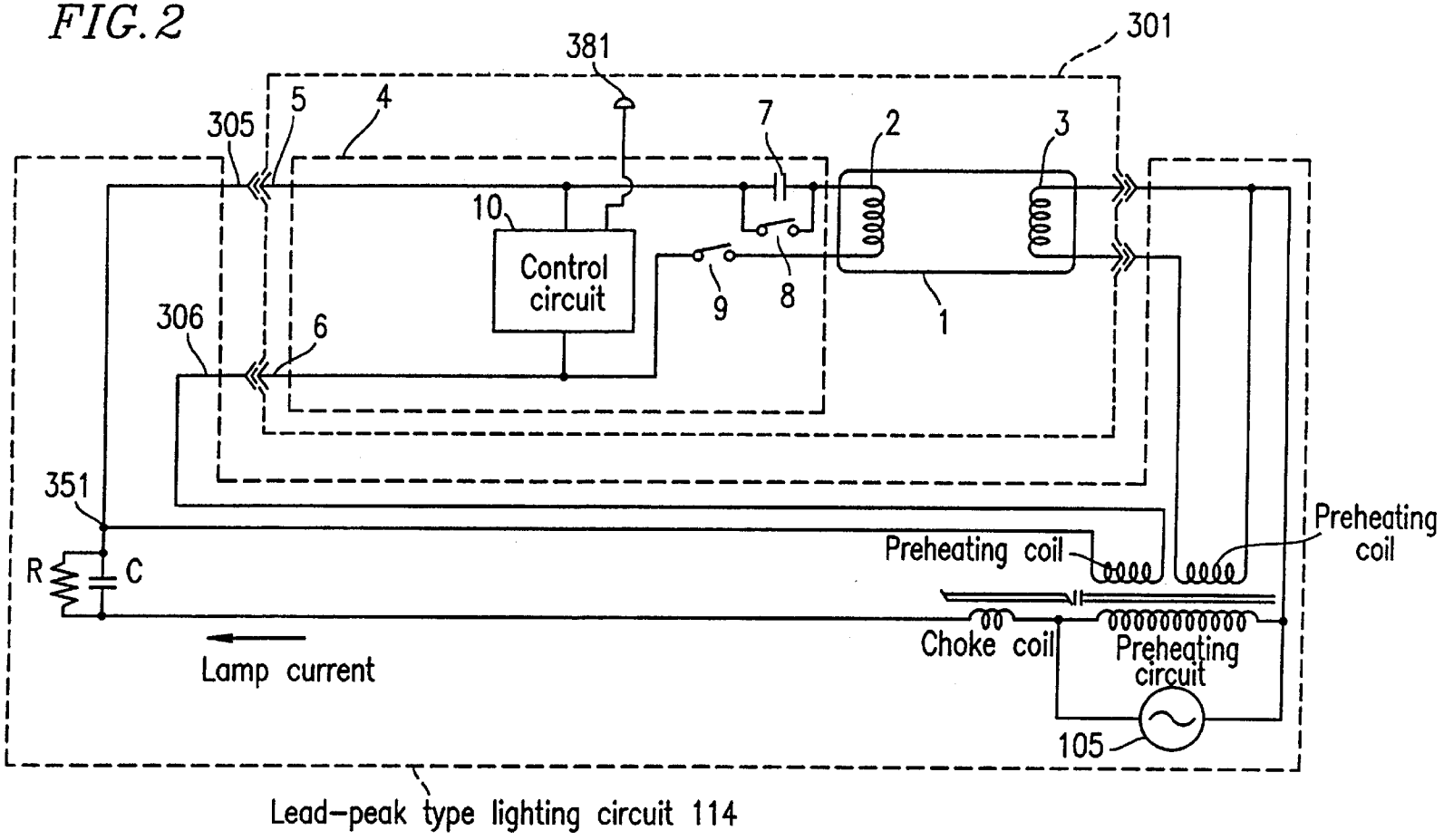
FIG. 2 is a circuit diagram of a fluorescent lamp 301 according to Example 1 of the present invention.

FIG. 2 is a circuit diagram of a fluorescent lamp 301 according to Example 1 of the present invention. FIG. 2 illustrates a state in which the fluorescent lamp 301 has been coupled to a lead-peak type lighting circuit 114.

The fluorescent lamp 301 includes: an emission tube 1, a power conservation circuit 4, a filament 2 (referred to as a "first filament") provided at one end of the emission tube 1, and a filament 3 (referred to as a "second filament") provided at the other end of the emission tube 1.

A fluorescent substance is applied to an inner wall of the emission tube 1. A discharge gas (e.g., mercury and noble gas) is encapsulated in the emission tube 1. During an ON-period of the fluorescent lamp 301, discharging occurs between the filament 2 and the filament 3, so that a lamp current flows between the filament 2 and the filament 3. Once discharging occurs between the filament 2 and the filament 3, the discharge gas generates ultraviolet rays, which activate the fluorescent substance so as to generate visible light. Thus, the emission tube 1 generates luminous flux.

The power conservation circuit 4 functions to light the fluorescent lamp 301 with a relatively small amount of power. Preferably, the power conservation circuit 4 is accommodated within a base of the fluorescent lamp 301.

The power conservation circuit 4 includes: a capacitor 7 (referred to as a "first current regulation means"); an electrode pin 5 (referred to as a "first electrode pin") which is coupled to one end of the filament 2 via the capacitor 7; a switch 8 (referred to as a "first switch") which is coupled in parallel to the capacitor 7; a switch 9 (referred to as a "second switch"); an electrode pin 6 (referred to as a "second electrode pin") which is coupled to the other end of the filament 2 via the switch 9; and a control circuit 10 which is coupled between the electrode pin 5 and the electrode pin 6. The control circuit 10 controls the switch 8 and the switch 9 so as to be open or closed.

In the case where the fluorescent lamp 301 is coupled to the lead-peak type lighting circuit 114, the electrode pin 5 of the fluorescent lamp 301 and an electrical contact 305 (referred to as a "source-side electrical contact) of the lead-peak type lighting circuit 114 are electrically interconnected, and the electrode pin 6 of the fluorescent lamp 301 and an electrical contact 306 (referred to as a "preheating coil-side electrical contact") of the lead-peak type lighting circuit 114 are electrically interconnected. Moreover, two electrode pins which are respectively coupled to both ends of the other filament 3 of the fluorescent lamp 301 are also electrically connected to two corresponding electrical contacts of the lighting circuit 114. The electrical contact 305 and the electrical contact 306 are both provided in a socket of an illumination device.

The control circuit 10 controls the switch 8 and the switch 9 so as to be opened or closed. Such control may be achieved by, for example, implementing the switch 8 and the switch 9 as relay switches, and controlling a current to flow or not to flow through the relay coils of the relay switches. In the case where the switches 8 and 9 are relay switches of a normally-closed type, the switches 8 and 9 can be controlled so as to be opened by flowing a current through a relay coil.

Figure 3:
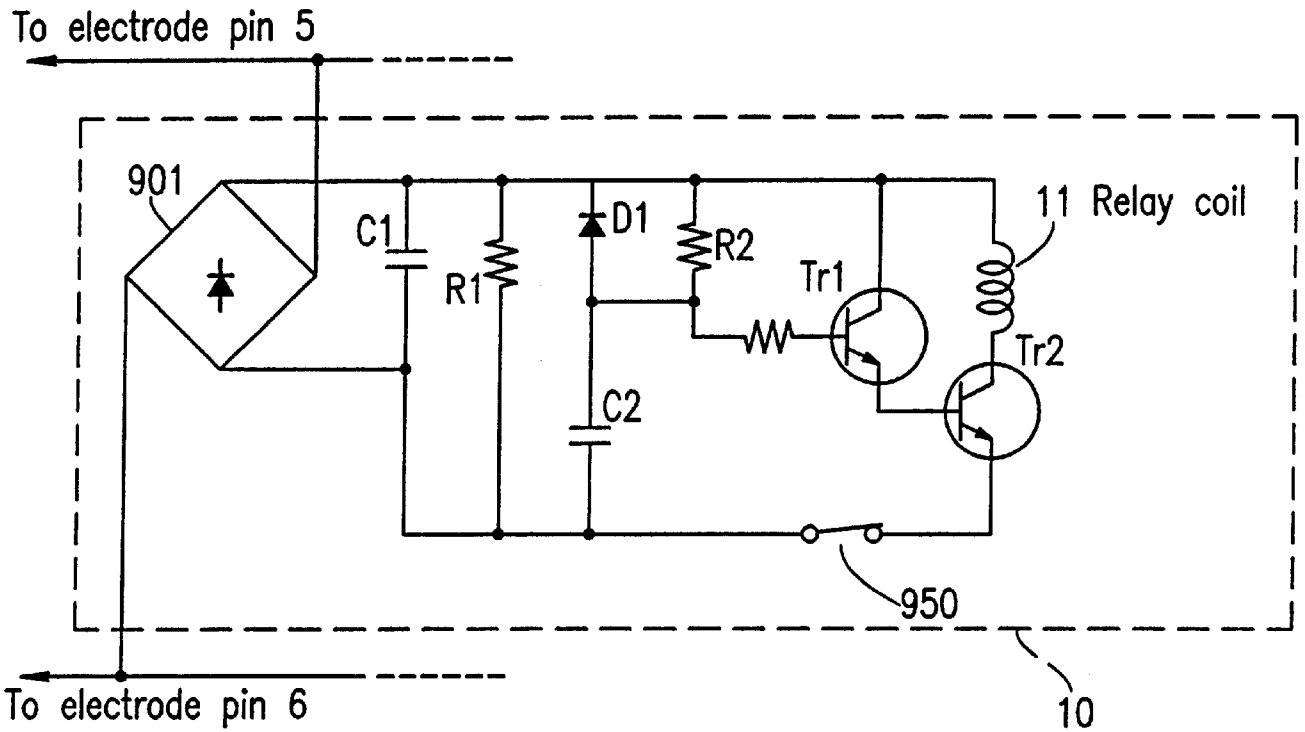
FIG. 3 is a circuit diagram of a control circuit 10.

FIG. 3 is a circuit diagram of the control circuit 10. As shown in FIG. 3, in accordance with the control circuit 10, a portion of a preheating current flowing between the electrode pin 5 and the electrode pin 6 is rectified by a diode bridge 901 and a capacitor C1. The resultant DC current is utilized as the power for the control circuit 10. At the time when power is supplied for lighting the fluorescent lamp 301, a capacitor C2 is charged via a resistor R2, and a voltage across the capacitor C2 increases with a time constant which is in proportion with C2×R2. Transistors Tr1 and Tr2 are coupled in the fashion of a Darlington connection (i.e., coupled in series). If the voltage across the capacitor C2 exceeds a voltage between a base of the transistor Tr1 and an emitter of the transistor Tr2 (which is about 1.4 V because there are two transistors employed in the illustrated circuit structure), the transistor Tr2 is turned ON, so that a current flows through a relay coil 11. The switches 8 and 9 (FIG. 2), which are composed of normally-closed contacts of the relay coil 11, are opened when a current flows through the relay coil 11.

Thus, after the lapse of a predetermined period of time since power is supplied, the control circuit 10 can open the switches 8 and 9.

Since the switches 8 and 9 are composed of normally-closed contacts of the relay coil 11, the switches 8 and 9 remain closed even if it becomes impossible to drive the relay coil 11 due to failure of the control circuit 10 or any other reasons. Therefore, the fluorescent lamp 301 can be satisfactorily lit in the fashion of a conventional rapid-start type fluorescent lamp.

A resistor R1 and a diode D1 are provided to facilitate quick discharging of the capacitor C2 when power supply is interrupted, so that the fluorescent lamp 301 becomes ready to be lit the next time power is supplied.

The switches 8 and 9 may be implemented as semiconductor relays of a contact-free type. It would also be possible to realize a timer function using an IC.

The control circuit 10 shown in FIG. 3 obtains DC power via full-wave rectification of a preheating current in the fluorescent lamp 301. Since a preheating source for a lead-peak type lighting circuit is usually on the order of 3 V to 4 V (AC), the control circuit 10 according to the present example does not require a transformer, so that the size and mass thereof can be reduced.

Figure 4:
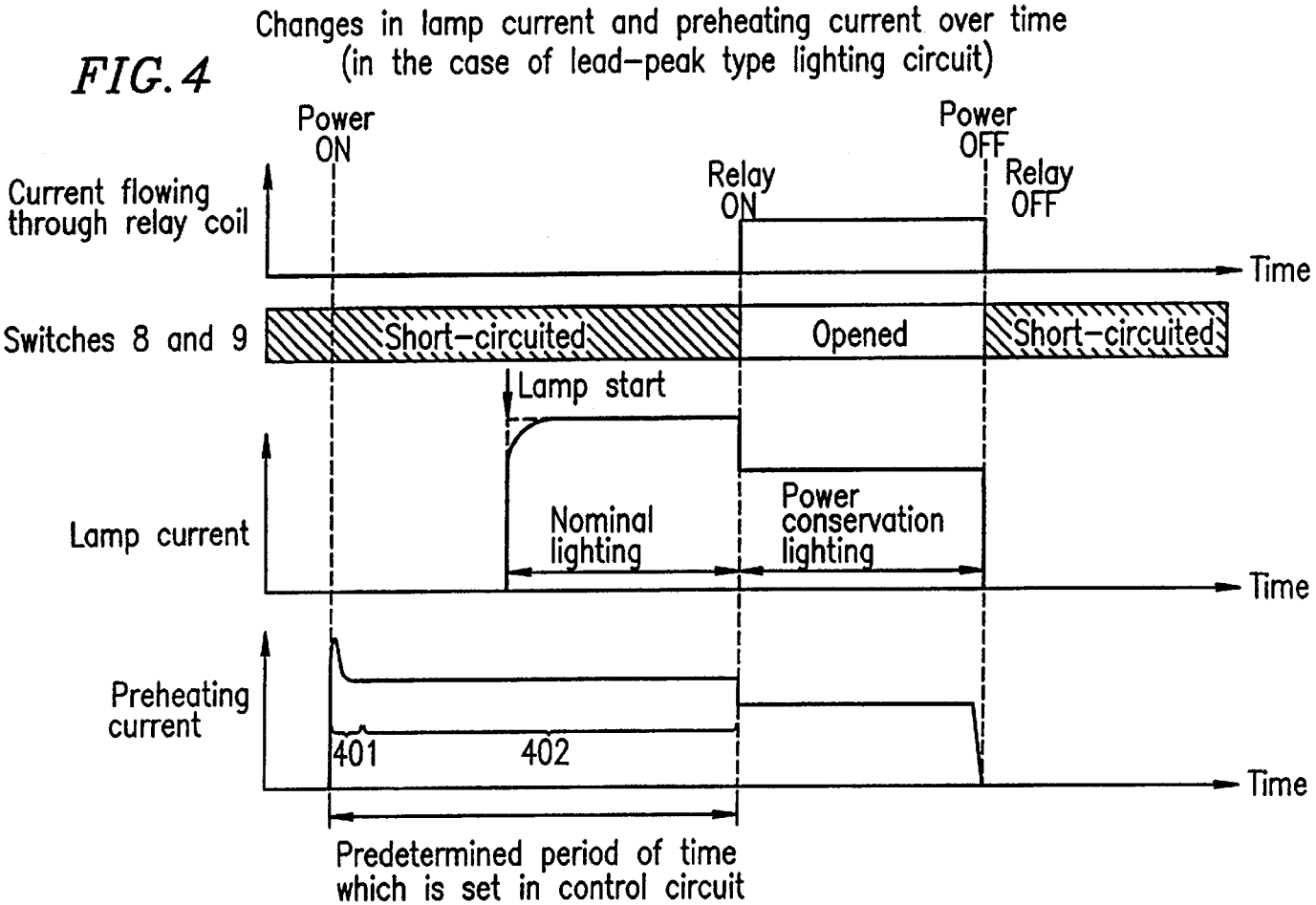
FIG. 4 is a timing diagram illustrating the operation of a switch 8 and a switch 9 (FIG. 2) during an ON-period of a fluorescent lamp 301, as well as changes in the values of a lamp current and a preheating current over time.

FIG. 4 is a timing diagram illustrating the operation of the switches 8 and 9 (FIG. 2) during an ON-period of the fluorescent lamp 301, as well as changes in the values of the lamp current and the preheating current over time. During a predetermined period of time since power is supplied, the control circuit 10 closes the switches 8 and 9. With the switches 8 and 9 being closed, the preheating current flows through the filament 2 without passing through the capacitor 7. Since the preheating current is not reduced by means of the capacitor 7, the fluorescent lamp 301 can be easily started. The aforementioned predetermined period of time is designed so as to be longer than an amount of time which is required for the fluorescent lamp 301 to be lit after power is supplied. Although a rapid-start type fluorescent lamp can generally be started immediately, interrupting the preheating current before a stable discharge is established may result in a failure of the fluorescent lamp to be lit under certain conditions such as low temperature. In order to prevent this problem, it is preferable to design the aforementioned predetermined period of time so as to be at least several seconds longer than an amount of time which is required for the fluorescent lamp 301 to be lit after power is supplied.

Thus, the control circuit 10 keeps the switches 8 and 9 closed before the fluorescent lamp 301 is lit and during a nominal lighting period after the fluorescent lamp 301 is lit. The control circuit 10 opens the switches 8 and 9 during a power conservation lighting period which follows the nominal lighting period.

In accordance with the lead-peak type lighting circuit 114, a predetermined voltage is applied between the filaments 2 and 3 after power is supplied. During a short period of time in which the filaments 2 and 3 become red-hot from a cold state which exists immediately after power is supplied, the resistance of the filament 2 and 3 undergoes a substantial change, with a corresponding substantial change in the preheating current ("period 401"). In due course, the preheating current takes a constant value ("period 402"). Once the filaments 2 and 3 have attained a sufficiently high temperature, the fluorescent lamp 301 is lit ("lamp start"). Once the fluorescent lamp 301 is lit, the lamp current flows through the electrode pin 5, the switch 8, the filament 2, and the filament 3. Since the lamp current is not reduced by means of the capacitor 7, a nominal level of lamp current flows ("nominal lighting period").

After the lapse of the aforementioned predetermined period of time since power is supplied, the control circuit 10 opens the switches 8 and 9. Once the switches 8 and 9 are opened, the preheating current flows through the electrode pin 5, the control circuit 10, and the electrode pin 6. The lamp current flows through a node 351, the electrode pin 5, the capacitor 7, the filament 2, and the filament 3. As a result, the lamp current is reduced by the capacitor 7. Consequently, the lamp power is reduced ("power conservation lighting period").

The capacitor 7 is employed as the first current regulation means in the exemplary structure shown in FIG. 2. However, the first current regulation means can be implemented as any circuit having an impedance; for example, a circuit including resistors, coils, thyristors, and capacitors may be used.

The switches 8 and 9 and the first current regulation means 7 shown in FIG. 2, the control circuit 10 shown in FIG. 3, and a control circuit 10*a* shown in FIG. 6 (described later) can all be constructed without employing a transformer. Therefore, the power conservation circuit 4 (FIG. 2) can be constructed with such a small size and mass that it can be incorporated within the base of the fluorescent lamp 301. Accordingly, the power-conserving type fluorescent lamp 301 according to the present example of the invention can simply be used to replace a conventional fluorescent lamp to realize a reduction in the power consumption.

During the power conservation lighting period, the preheating current is reduced, due to the impedance of the control circuit 10, as compared to the case where the preheating current flows through the filament 2. The input impedance of the control circuit 10 before the fluorescent lamp 301 is started is designed so as to be sufficiently greater than the impedance of the filament 2. If the input impedance of the control circuit 10 before the fluorescent lamp 301 is started is small, a sufficient preheating current will not flow through the filament 2, so that the fluorescent lamp 301 cannot be started. Since the transistors Tr1 and Tr2 (FIG. 3) are in an OFF state before the fluorescent lamp 301 is started, the value of the resistor R1 is predominant on the input impedance of the control circuit 10. Accordingly, in order to ensure that a sufficient preheating current flows through the filament 2, the value of the resistor R1 can be designed so as to be sufficiently greater than the impedance of the filament 2. For example, if the impedance of the filament 2 is in the range of about 2 to about 20 Ω, then the value of the resistor R1 is preferably set to be about 1 kΩ.

Thus, during the nominal lighting period of the control circuit 10 after the fluorescent lamp 301 is lit, the switches 8 and 9 are closed (i.e., short-circuited). During the power conservation lighting period following the nominal lighting period, the switches 8 and 9 are opened.

As shown in FIG. 4, in accordance with the fluorescent lamp 301 of the present invention, during the power conservation lighting period, both the preheating current and the lamp current become smaller than in the nominal lighting period. The reduction in the lamp current plays a more important role in the reduction of the power consumption by the fluorescent lamp 301 because the preheating current is generally smaller than the lamp current. For example, when the fluorescent lamp 301 is coupled to a lead-peak type lighting circuit which is designed for a single 40 W fluorescent lamp, interrupting the preheating current during the ON-period of the fluorescent lamp 301 only realizes a reduction in power consumption by about 2 W (i.e., about 5% of the nominal power consumption of the fluorescent lamp 301). On the other hand, reducing the lamp current can realize a 30% or more reduction in the power consumption. During the power conservation lighting period, since the transistors Tr1 and Tr2 are in an ON state, the impedance of the relay coil 11 is predominant on the impedance of the control circuit 10. Therefore, in order to attain a smaller preheating current during the power conservation lighting period than in the nominal lighting period, the impedance of the relay coil 11 is prescribed so as to be greater than the impedance of the filament 2. For example, the impedance of the relay coil 11 may be prescribed to be about 100 Ω. As a result, the input impedance of the control circuit 10 during the power conservation lighting period becomes greater than the impedance of the filament 2 (about 2 to about 20 Ω).

Figure 5:
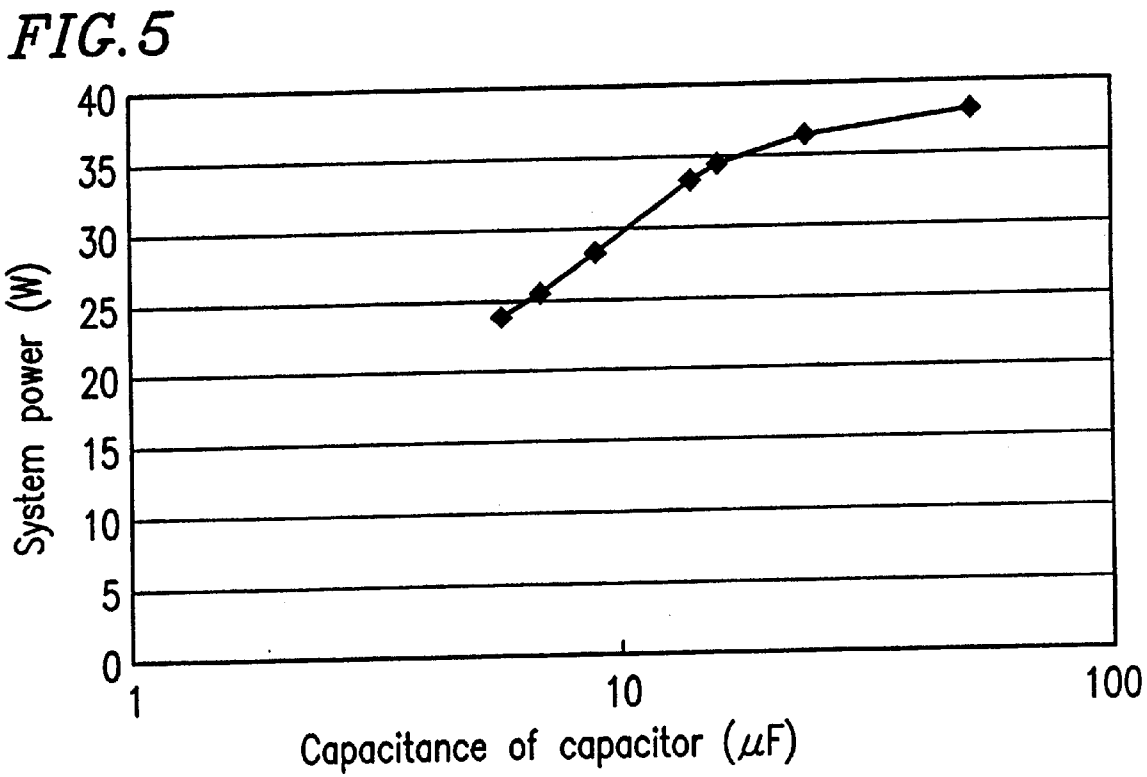
FIG. 5 is a graph illustrating a system power of an illumination device relative to the capacitance of a capacitor 7.

FIG. 5 is a graph illustrating a system power of an illumination device relative to the capacitance of the capacitor 7. As used herein, the "system power" of an illumination device is defined as a sum of the power consumption by the fluorescent lamp 301 and the power consumption by the lead-peak type lighting circuit 114. A product which is equivalent to FLR40S/M-X is used as the fluorescent lamp 301 to derive the graph of FIG. 5.

The system power associated with the FLR40S/M-X type fluorescent lamp during the nominal lighting period is about 44 W. As seen from FIG. 5, by appropriately selecting the value of the capacitor 7, a 10% or more reduction in the power consumption can be achieved relative to the power consumption during the nominal lighting period. In the case where the fluorescent lamp 301 shown in FIG. 2 is coupled to a resonance type lighting circuit, no substantial reduction in the power consumption can be obtained. The reason is that, even if the lamp current is regulated by means of the capacitor 7, given the substantially unchanged preheating current, the lamp current will be maintained at a constant value due to the characteristics of the resonance type lighting circuit.

In the example illustrated in FIG. 3, the control circuit 10 opens the switches 8 and 9 after the lapse of a predetermined period of time since power is supplied. That is, the control circuit 10 illustrated in FIG. 3 controls the switches 8 and 9 against a time parameter. However, the parameter against which the control circuit controls the switches 8 and 9 is not limited to time. The control circuit may control the switches 8 and 9 by using the luminous flux from the emission tube 1 of the fluorescent lamp 301 as a parameter, for example.

Figure 6:
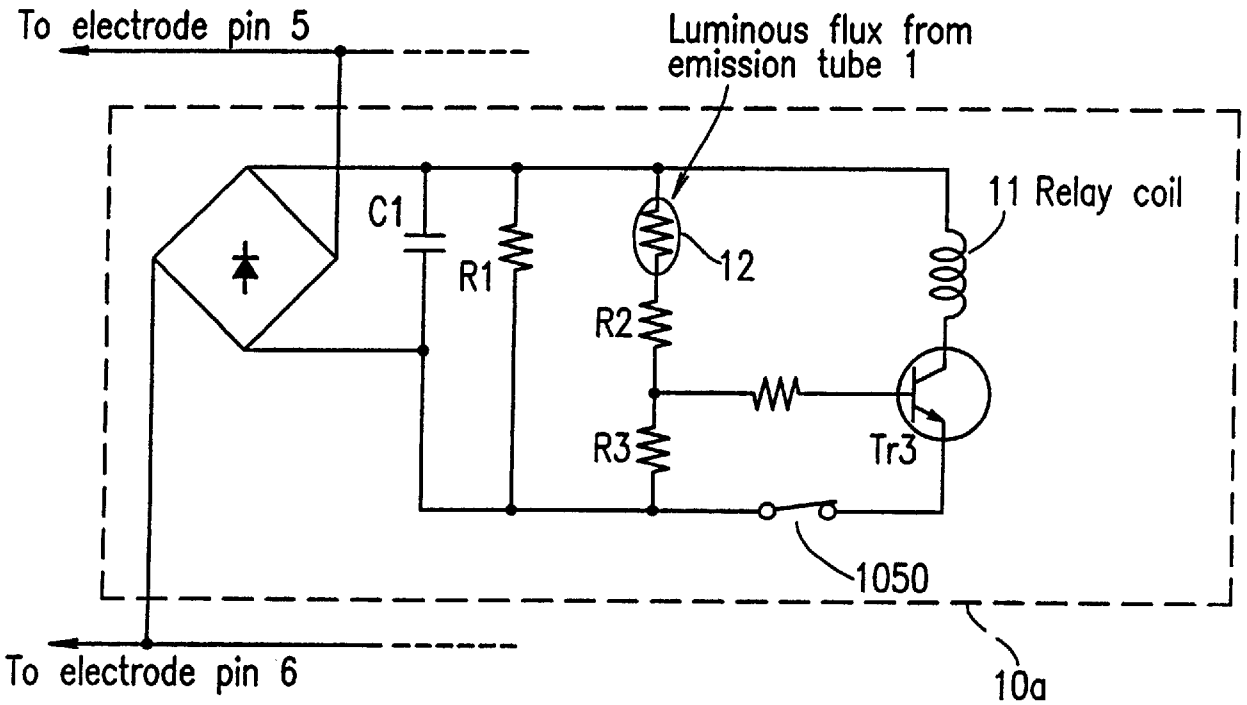
FIG. 6 is a circuit diagram of a control circuit 10*a* for controlling a switch 8 and a switch 9 by using a luminous flux from an emission tube 1 as a parameter.

FIG. 6 is a circuit diagram of a control circuit 10*a* for controlling the switches 8 and 9 by using a luminous flux from the emission tube 1 as a parameter. The control circuit 10*a* may be employed instead of the control circuit 10 in the fluorescent lamp 301 shown in FIG. 2. In FIG. 6, constituent elements which also appear in FIG. 3 are denoted by the same reference numerals as those used therein, and the associated description is omitted. The control circuit 10*a* controls the switches 8 and 9 so as to be opened or closed.

The control circuit 10*a* includes an optical sensor 12 (referred to as a "luminous flux detection means"). The optical sensor 12 may be a CdS photoconductive sensor, for example. The optical sensor 12 is disposed in a position where it is capable of detecting the luminous flux generated by the emission tube 1 of the fluorescent lamp 301. The optical sensor 12 has characteristics such that the resistance value thereof decreases as the detected luminous flux increases.

Hereinafter, an operation which occurs in the case where the control circuit boa is employed instead of the control circuit 10 in the fluorescent lamp 301 shown in FIG. 2 will be described.

When power is supplied for lighting the fluorescent lamp 301, the optical sensor 12 monitors the luminous flux generated by the emission tube 1. Before the fluorescent lamp 301 is started, the emission tube 1 does not generate a luminous flux. In this case, the optical sensor 12 has a high resistance value, so that a relatively low voltage is applied to a gate of the transistor Tr3, leaving the transistor Tr3 in an OFF state. Accordingly, no current flows through the relay coil 11. Therefore, the switches 8 and 9 (FIG. 2) are both closed, so that the preheating current flows through the filament 2 without passing through the capacitor 7. Since the preheating current is not reduced by the capacitor 7, the fluorescent lamp 301 can be easily started.

Immediately after the fluorescent lamp 301 is started, the temperature of the fluorescent lamp 301 is low and the luminous flux generated by the emission tube 1 is insignificant, so that the transistor Tr3 remains OFF. Accordingly, the switches 8 and 9 are both closed so that a nominal level of lamp current flows ("nominal lighting period").

The temperature of the fluorescent lamp 301 gradually increases due to the discharging of the fluorescent lamp 301 with the lapse time after the fluorescent lamp 301 is started. Concurrently, the luminous flux generated by the emission tube 1 increases. When the luminous flux detected by the optical sensor 12 reaches a predetermined value, the transistor Tr3 is turned ON, so that a current flows in the relay coil 11. As a result, the switches 8 and 9 are opened, so that the lamp current flows through the capacitor 7. Thus, the lamp current is reduced by means of the capacitor 7. As a result, the lamp power is reduced ("power conservation lighting period"). The value of the resistor R1 and the impedance of the relay coil 11 are prescribed in the same manner as in the control circuit 10 described with reference to FIG. 3.

As described above, the control circuit 10*a* controls the switches 8 and 9 by using the luminous flux generated by the emission tube 1 of the fluorescent lamp 301 as a parameter. According to this method, in the case where the luminous flux generated by the emission tube 1 rises slowly due to a relatively low ambient temperature, the regulation of the preheating current through the filament 2 or the reduction in the lamp current is not performed until the luminous flux generated by the emission tube 1 becomes sufficiently large. Hence, problems associated with the failure of the fluorescent lamp 301 to be lit, or a further delay in the rising of the luminous flux generated by the emission tube 1, can be avoided.

Thus, the control circuit 10*a* keeps the switches 8 and 9 closed before the fluorescent lamp 301 is lit and during a nominal lighting period after the fluorescent lamp 301 is lit. The control circuit 10*a* opens the switches 8 and 9 during a power conservation lighting period which follows the nominal lighting period.

The optical sensor 12 may be implemented as a silicon photodiode, instead of a CdS photoconductive sensor.

In the exemplary structure illustrated in FIG. 2, the electrode pin 5 of the fluorescent lamp 301 and the electrical contact 305 (referred to as the "source-side electrical contact") of the lighting circuit 114 are electrically interconnected, whereas the electrode pin 6 of the fluorescent lamp 301 and the electrical contact 306 (referred to as the "preheating coil-side electrical contact") of the lighting circuit 114 are electrically interconnected. However, the fluorescent lamp 301 and the lead-peak type lighting circuit 114 may be coupled so as to result in an opposite electrical connection and the fluorescent lamp 301 can still operate satisfactorily.

Figure 7:
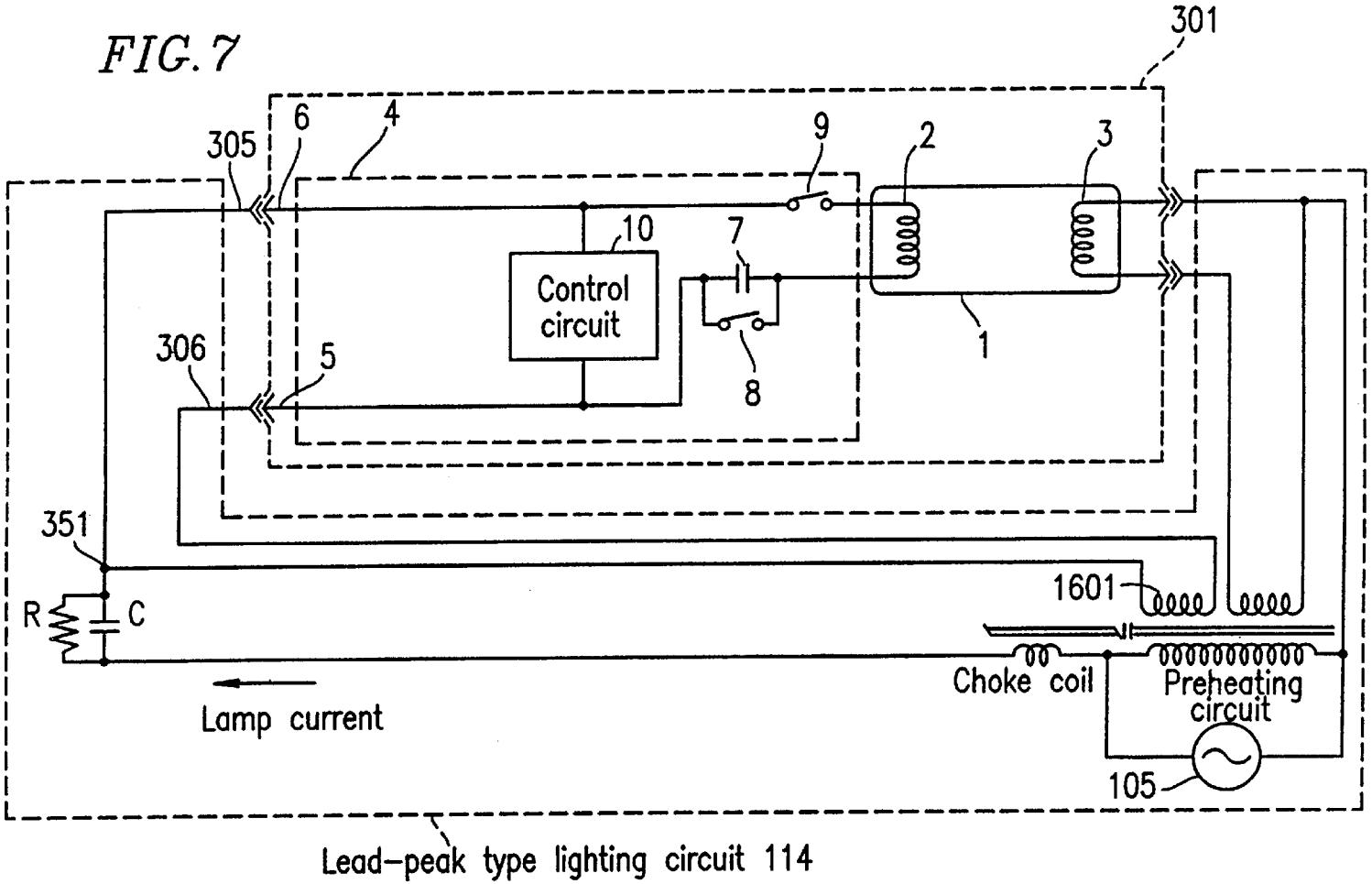
FIG. 7 is a circuit diagram illustrating a state in which a fluorescent lamp 301 and a lead-peak type lighting circuit 114 are coupled so as to result in an opposite electrical connection of that shown in FIG. 2.

FIG. 7 is a circuit diagram illustrating a state in which the fluorescent lamp 301 and the lead-peak type lighting circuit 114 are coupled so as to result in an opposite electrical connection of that shown in FIG. 2. Specifically, in the structure shown in FIG. 7, the electrode pin 6 and the electrical contact 305 are electrically interconnected, whereas the electrode pin 5 and the electrical contact 306 are electrically interconnected. In this case, after the control circuit 10 opens the switches 8 and 9 (i.e., during the power conservation lighting period), the lamp current mainly flows through the node 351, the preheating coil 1601, the electrical contact 306, the electrode pin 5, the capacitor 7, the filament 2, and the filament 3.

In accordance with the electrical connection illustrated in FIG. 7, the lamp current during the power conservation lighting period is under the influence of the impedance of the preheating coil 1601, and therefore is decreased more than in the case of the electrical connection illustrated in FIG. 2. As a result, a greater reduction in power consumption can be obtained. Thus, by simply changing the electrical connection between the fluorescent lamp 301 and the lead-peak type lighting circuit 114, i.e., by changing the orientation in which the fluorescent lamp 301 is mounted to an illumination device, different levels of reduction in power consumption can be realized.

However, it is foreseeable that the same level of reduction in power consumption may be desirable even by changing the electrical connection between the fluorescent lamp 301 and the lead-peak type lighting circuit 114.

Figure 8:
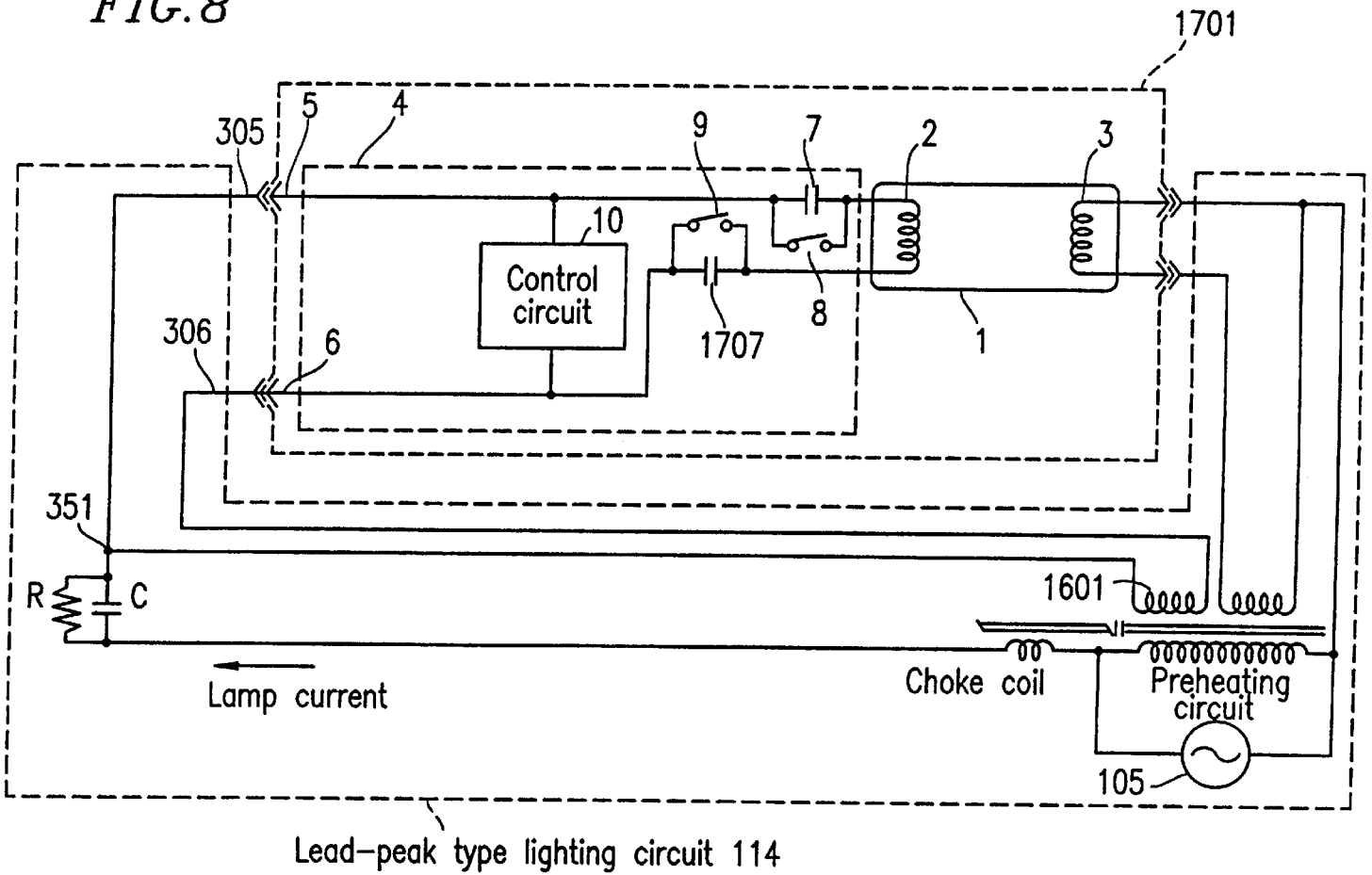
FIG. 8 is a circuit diagram of a fluorescent lamp 1701 which provides a constant level of reduction in power consumption irrespective of the electrical connection between itself and a lead-peak type lighting circuit 114.

FIG. 8 is a circuit diagram of a fluorescent lamp 1701 which provides a constant level of reduction in power consumption irrespective of the electrical connection between itself and a lead-peak type lighting circuit 114. In FIG. 8, constituent elements which also appear in FIG. 2 are denoted by the same reference numerals as those used therein, and the associated description is omitted. The fluorescent lamp 1701 includes a capacitor 1707 in addition to the constituent elements of the fluorescent lamp 301 (FIG. 2). The capacitor 1707 is coupled in parallel to the switch 9. The capacitance of the capacitor 1707 is prescribed to be equal to that of the capacitor 7. The lamp current is regulated by means of a compound impedance of the capacitor 1707 and the capacitor 7.

During the power conservation lighting period of the fluorescent lamp 1701, the lamp current mainly flows through a node 351, an electrical contact 305, an electrode pin 5, a capacitor 7, a filament 2, and a filament 3. A portion of the lamp current flows through the node 351, a preheating coil 1601, an electrical contact 306, an electrode pin 6, a capacitor 1707, the filament 2, and the filament 3. The impedance of the current path including the electrode pin 6, the capacitor 1707, and the filament 2 is equal to the impedance of the current path including the electrode pin 5, the capacitor 7, and the filament 2. As a result, the lamp current will remain unchanged even if the electrical connection between the fluorescent lamp 1701 and the lead-peak type lighting circuit 114 is changed so that the electrode pin 5 and the electrical contact 306 are interconnected and that the electrode pin 6 and the electrical contact 305 are interconnected.

Thus, the fluorescent lamp 1701 provides a constant level of reduction in power consumption irrespective of the electrical connection between the fluorescent lamp 1701 and the lead-peak type lighting circuit 114.

EXAMPLE 2

As Example 2 of the present invention, a fluorescent lamp according to the present invention which can be used in conjunction with a resonance type lighting circuit will be described.

Figure 9:
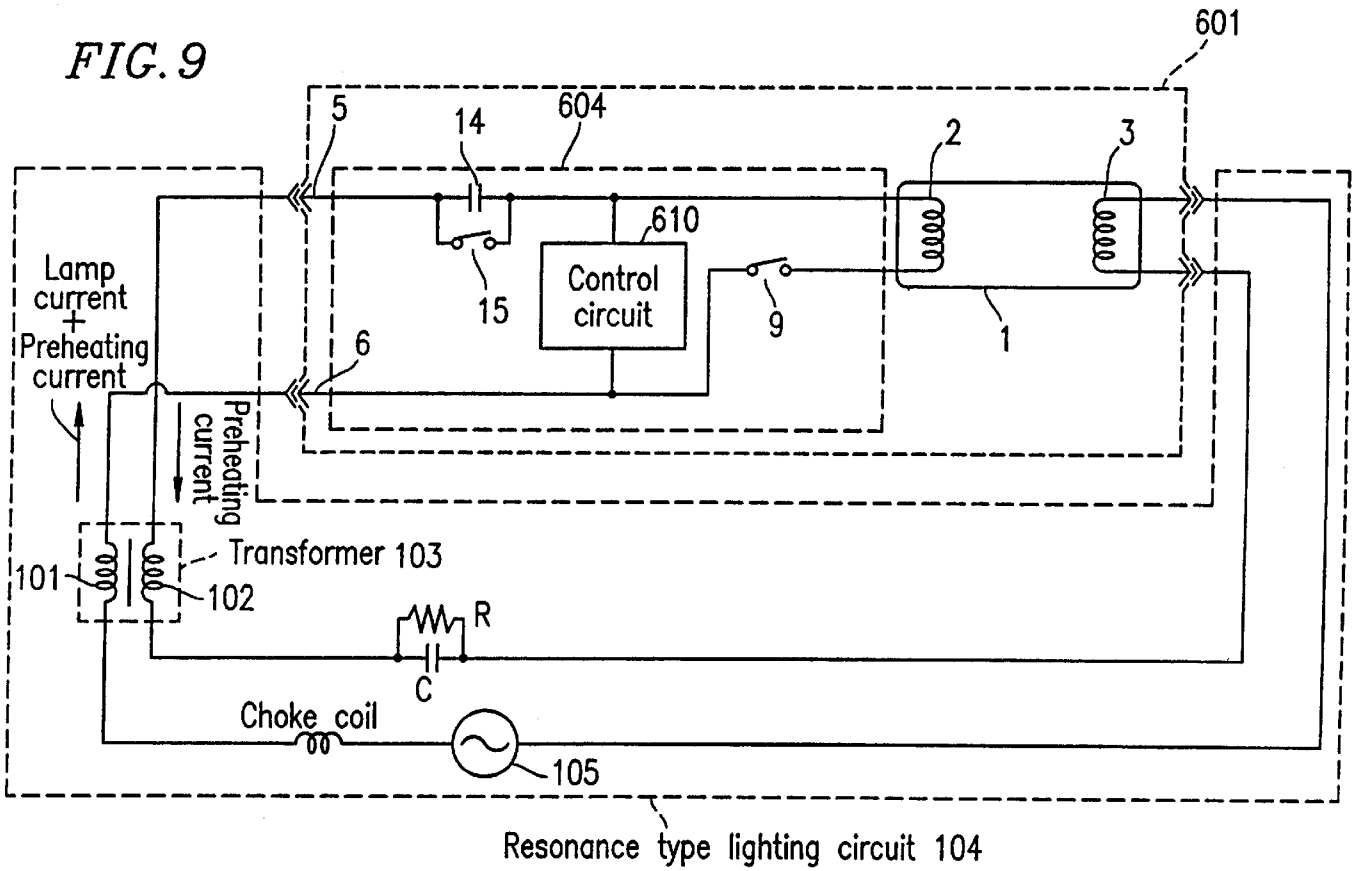
FIG. 9 is a circuit diagram of a fluorescent lamp 601 according to Example 2 of the present invention.

FIG. 9 is a circuit diagram of a fluorescent lamp 601 according to Example 2 of the present invention. FIG. 9 illustrates a state in which the fluorescent lamp 601 is coupled to a resonance type lighting circuit 104.

In FIG. 9, constituent elements which also appear in FIGS. 1A and 2 are denoted by the same reference numerals as those used therein, and the associated description is omitted.

The fluorescent lamp 601 includes a power conservation circuit 604 instead of the power conservation circuit 4 in the fluorescent lamp 301 (FIG. 2).

The power conservation circuit 604 functions to light the fluorescent lamp 601 with a relatively small amount of power. The power conservation circuit 604 is preferably accommodated within a base of the fluorescent lamp 601.

The power conservation circuit 604 includes: a capacitor 14 (referred to as a "second current regulation means"); an electrode pin 5 (referred to as a "first electrode pin") which is coupled to one end of the filament 2 via the capacitor 14; a switch 15 (referred to as a "third switch") which is coupled in parallel to the capacitor 14; a switch 9 (referred to as a "second switch"); an electrode pin 6 (referred to as a "second electrode pin") which is coupled to the other end of the filament 2 via the switch 9; and a control circuit 610 which is coupled between one end of the filament 2 and the electrode pin 6. The control circuit 610 controls the switch 9 and the switch 15 so as to be open or closed. As the control circuit 610, for example, the control circuit 10 shown in FIG. 3 or the control circuit 10*a* shown in FIG. 6 may be used. In the following description, it is assumed that the control circuit 10 shown in FIG. 3 is used as the control circuit 610.

Figure 10:
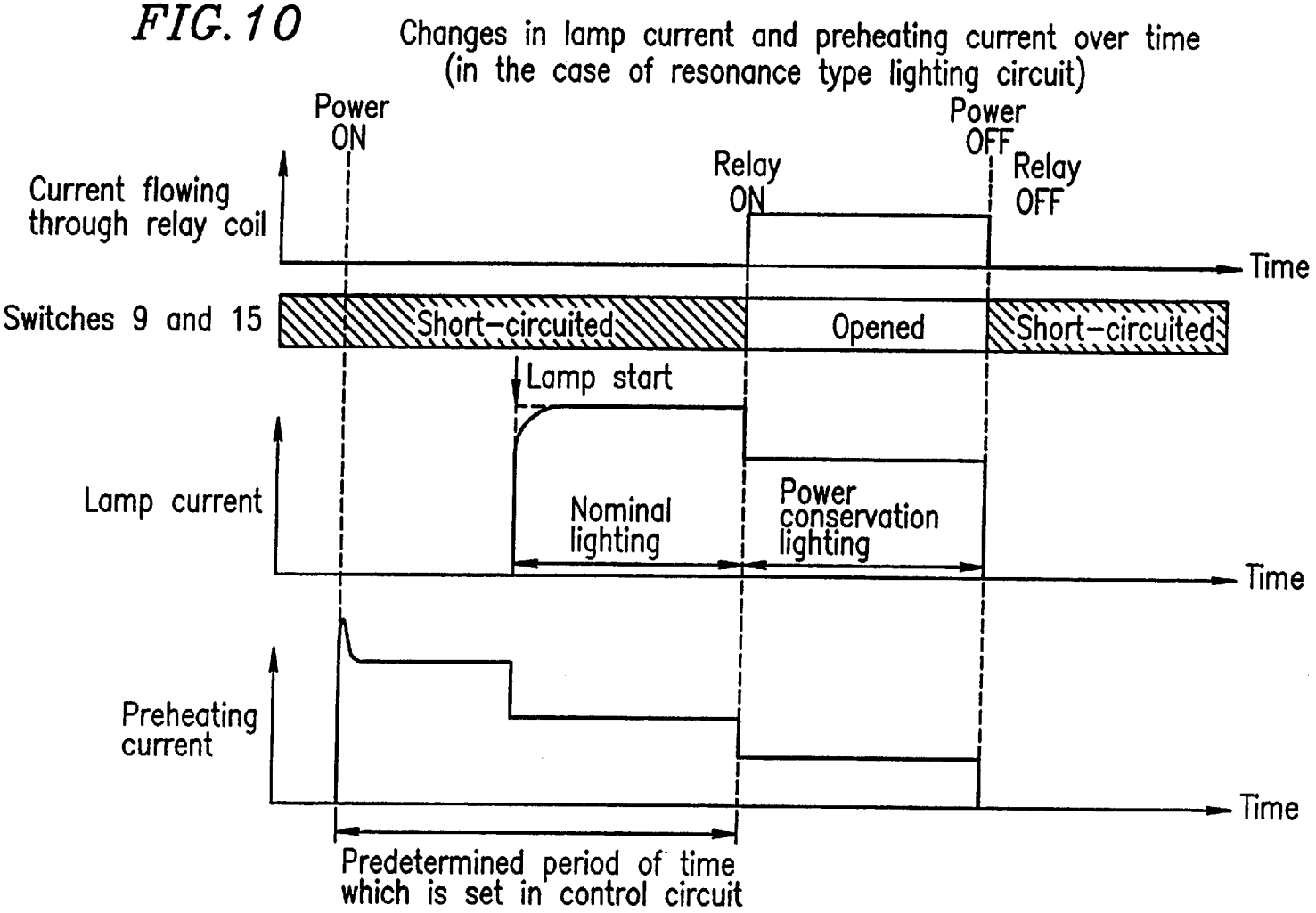
FIG. 10 is a timing diagram illustrating the operation of a switch 9 and a switch 15 during an ON-period of a fluorescent lamp 601, as well as changes in the values of a lamp current and a preheating current over time.

FIG. 10 is a timing diagram illustrating the operation of the switches 9 and 15 during an ON-period of the fluorescent lamp 601, as well as changes in the values of the lamp current and the preheating current over time. During a predetermined period of time after power is supplied, the control circuit 610 (FIG. 9) short-circuits each of the switch 9 and the switch 15. With the switch 9 and the switch 15 being short-circuited, the preheating current flows through the filament 2 without passing through the capacitor 14; that is, the preheating current flows through the electrode pin 6, the switch 9, the filament 2, the switch 15, and the electrode pin 5. Since the preheating current is not reduced by means of the capacitor 14, the fluorescent lamp 601 can be easily started ("lamp start").

During a predetermined period of time (which is set in the control circuit 610) after power is supplied, the control circuit 610 short-circuits each of the switch 9 and the switch 15.

In accordance with the resonance type lighting circuit 104, a large current flows through the filament 2 and the filament 3 before the fluorescent lamp 601 is lit. Moreover, a high start voltage which is generated by a resonance circuit composed of a resistor R and a capacitance C is applied between the filament 2 and the filament 3. Once the filaments 2 and 3 have attained a sufficiently high temperature, the fluorescent lamp 601 is lit ("lamp start").

After the fluorescent lamp 601 is lit, the lamp current assumes a nominal value. The preheating current takes a constant value ("nominal lighting period").

After the lapse of the predetermined period of time which is set in the control circuit 610 since power is supplied, the switches 9 and 15 are opened. Once the switches 9 and 15 are opened, the preheating current flows through the electrode pin 5, the capacitor 14, the control circuit 610, and the electrode pin 6. The lamp current flows through the electrode pin 6, the control circuit 610, the filament 2, and the filament 3. The preheating current is reduced by means of the capacitor 14. As a result, the transformer 103 has an increased impedance, so that the lamp current is reduced. Thus, the power consumption by the fluorescent lamp 601 can be reduced ("power conservation lighting period").

Figure 11:
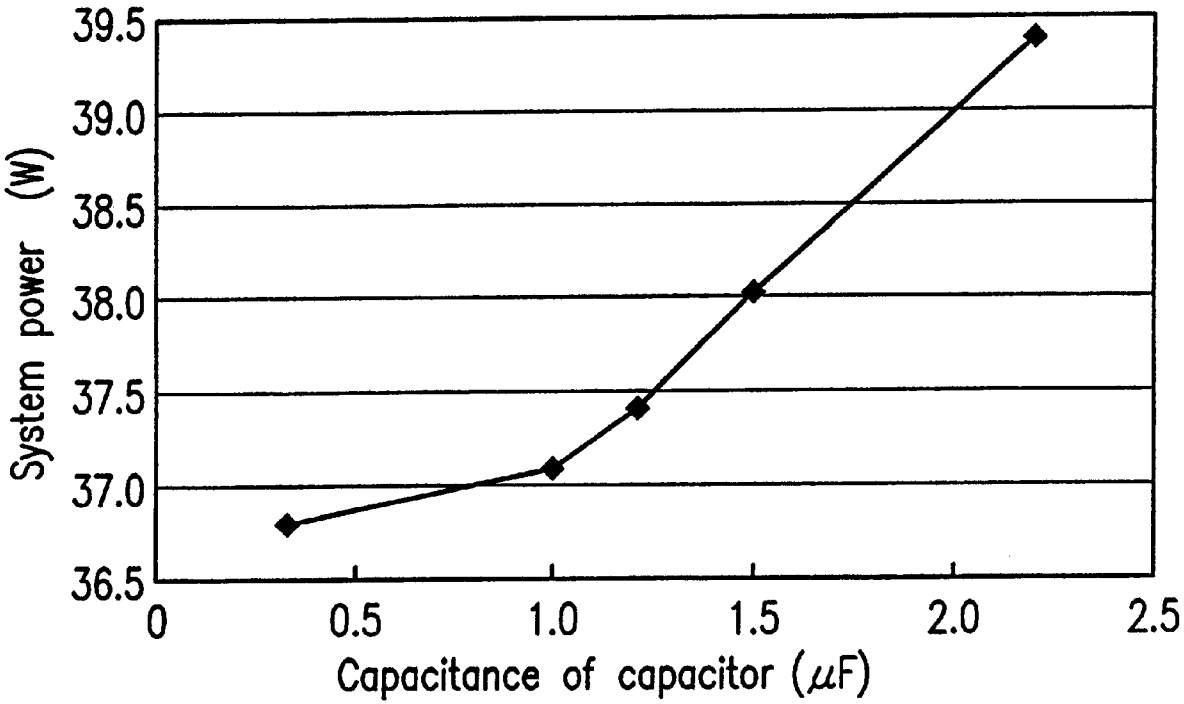
FIG. 11 is a graph illustrating a system power of an illumination device relative to the capacitance of a capacitor 14.

FIG. 11 is a graph illustrating a system power of an illumination device relative to the capacitance of the capacitor 14. As used herein, the "system power" of an illumination device is defined as a sum of the power consumption by the fluorescent lamp 601 and the power consumption by the resonance type lighting circuit 104. A product which is equivalent to FLR40S/M-X is used as the fluorescent lamp 601 to derive the graph of FIG. 11.

The system power associated with the fluorescent lamp 601 in the case where the switch 15 is short-circuited ("nominal lighting period") is about 47 W. As seen from FIG. 11, by appropriately selecting the value of the capacitor 14, a 10% or more reduction in the power consumption can be achieved relative to the power consumption during the nominal lighting period. In the case where the fluorescent lamp 601 is coupled to the lead-peak type lighting circuit 114 (FIG. 2), a smaller reduction in the power consumption results. The reason is that, when the fluorescent lamp 601 is coupled to the lead-peak type lighting circuit 114, the preheating current may be reduced by means of the capacitor 14 and the control circuit 610, but the lamp current is not substantially reduced. As described above, in the case of the lead-peak type lighting circuit 114, the reduction in power consumption which is obtained by reducing the preheating current is relatively small.

The second current regulation means can be implemented as any circuit having an impedance, instead of the capacitor 14; for example, a circuit including resistors, coils, thyristors, and capacitors may be used.

EXAMPLE 3

As Example 3 of the present invention, a fluorescent lamp according to the present invention which can be used in conjunction with both a lead-peak type lighting circuit and a resonance type lighting circuit will be described.

Figure 12:
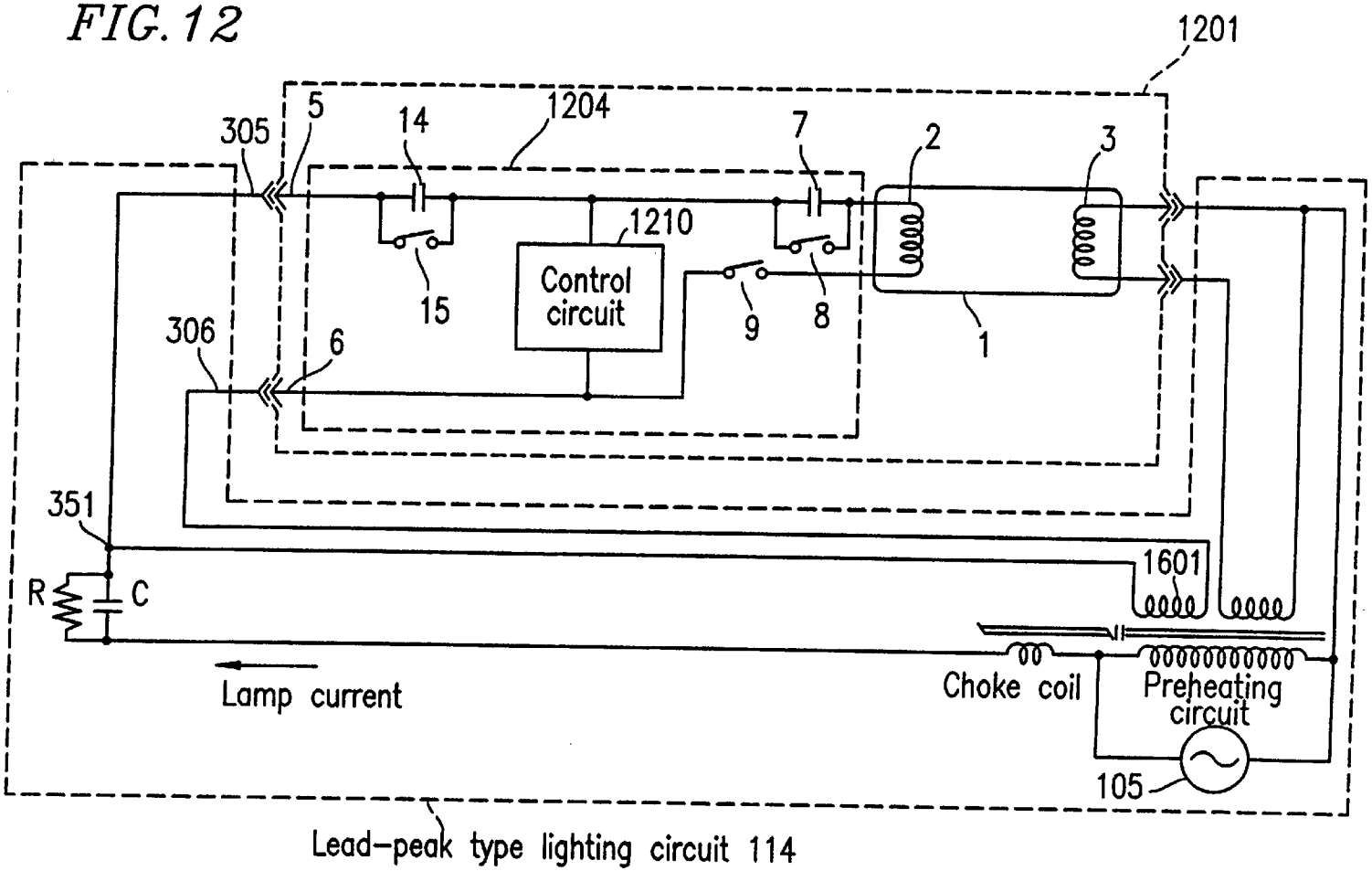
FIG. 12 is a circuit diagram of a fluorescent lamp 1201 according to Example 3 of the present invention.

FIG. 12 is a circuit diagram of a fluorescent lamp 1201 according to Example 3 of the present invention. FIG. 12 illustrates a state in which the fluorescent lamp 1201 is coupled to a lead-peak type lighting circuit 114. In FIG. 12, constituent elements which also appear in FIG. 2 are denoted by the same reference numerals as those used therein, and the associated description is omitted.

The fluorescent lamp 1201 includes a power conservation circuit 1204 instead of the power conservation circuit 4 in the fluorescent lamp 301 (FIG. 2).

The power conservation circuit 1204 includes a control circuit 1210, instead of the control circuit 10 of the power conservation circuit 4. The power conservation circuit 1204 further includes a capacitor 14 (referred to as a "second current regulation means") and a switch 15 (referred to as a "third switch"). The control circuit 1210 is coupled to electrode pin 5 (referred to as a "first electrode pin") via the capacitor 14. The switch 15 is coupled in parallel to the capacitor 14. The control circuit 1210 controls the switch 8, the switch 9 and the switch 15 so as to be opened or closed. As the control circuit 1210, for example, the control circuit 10 shown in FIG. 3 or the control circuit 10*a* shown in FIG. 6 may be used. In the following description, it is assumed that the control circuit 10 shown in FIG. 3 is used as the control circuit 1210.

Figure 13:
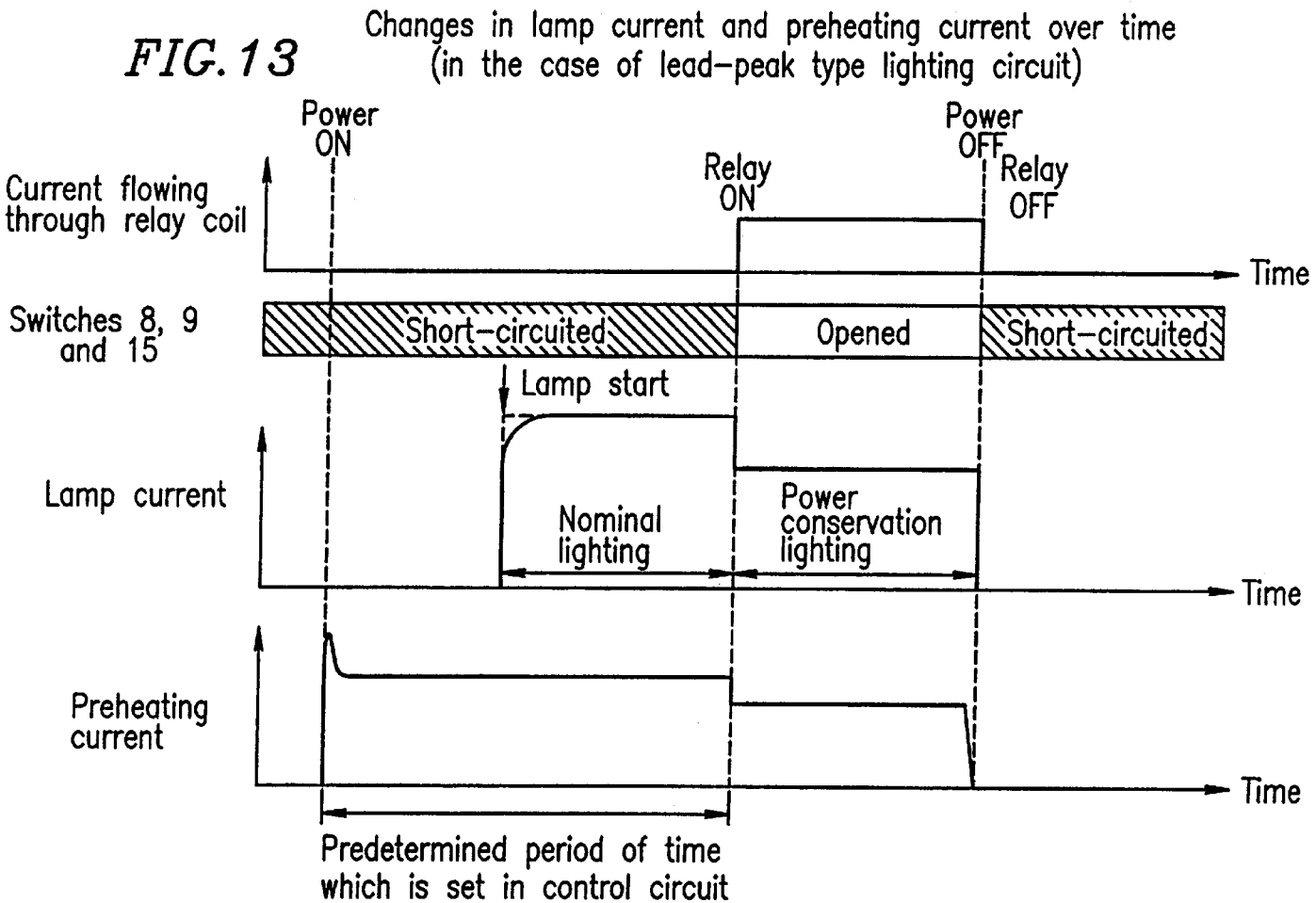
FIG. 13 is a timing diagram illustrating the operation of a switch 8, a switch 9, and a switch 15 in the case where a fluorescent lamp 1201 is coupled to a lead-peak type lighting circuit 114, as well as changes in the values of a lamp current and a preheating current over time.

FIG. 13 is a timing diagram illustrating the operation of a switch 8, a switch 9, and a switch 15 in the case where the fluorescent lamp 1201 is coupled to a lead-peak type lighting circuit 114, as well as changes in the values of a lamp current and a preheating current over time. During a predetermined period of time since power is supplied, the control circuit 1210 (FIG. 12) closes the switches 8, 9 and 15. With the switches 8, 9 and 15 being closed, the fluorescent lamp 1201 can be easily started ("lamp start") as is the case with the operation of the fluorescent lamp 301 described with reference to FIG. 4.

Once the fluorescent lamp 1201 is lit, the lamp current flows through the electrode pin 5, the switch 15, the switch 8, the filament 2, and the filament 3. Since the lamp current is not reduced by means of the capacitors 14 and 7, a nominal level of lamp current flows ("nominal lighting period"). In the case where a product which is equivalent to FLR40S/M-X is used as the fluorescent, lamp 1201, the nominal lamp current level is about 360 mA.

After the lapse of the predetermined period of time since power is supplied, the control circuit 1210 opens the switches 8, 9 and 15. Once the switches 8, 9 and 15 are opened, the preheating current flows through the electrode pin 5, the capacitor 14, the control circuit 1210, and the electrode pin 6. A portion of the lamp current flows through the node 351, the electrode pin 5, the capacitor 14, the capacitor 7, the filament 2, and the filament 3 (defined as "path 1"). The remainder of the lamp current flows through the node 351, the preheating coil 1601, the electrode pin 6, the control circuit 1210, the capacitor 7, the filament 2, and the filament 3 (defined as "path 2"). Since the partial lamp current which is transmitted through pass 1 and the partial lamp current which is transmitted through pass 2 are both reduced by means of the capacitor 7, the lamp current is reduced as compared to the lamp current during the nominal lighting period ("power conservation lighting period").

As shown in FIG. 13, when the fluorescent lamp 1201 according to the present invention is coupled to the lead-peak type lighting circuit 114, both the preheating current and the lamp current during the power conservation lighting period are reduced as compared with those during the nominal lighting period. The reduction in the lamp current plays a more important role in the reduction of the power consumption by the fluorescent lamp 1201 because the preheating current is generally smaller than the lamp current. For example, when the fluorescent lamp 1201 is coupled to a lead-peak type lighting circuit which is designed for a single 40 W fluorescent lamp, interrupting the preheating current during the ON-period of the fluorescent lamp 1201 only realizes a reduction in power consumption by about 2 W (i.e., about 5% of the nominal power consumption of the fluorescent lamp 1201). On the other hand, regulating the lamp current by means of the capacitor 7 makes it possible to substantially reduce the power consumption.

During the power conservation lighting period, the preheating current is reduced by means of the preheating current control capacitor 14, so that the control circuit 1210 cannot utilize the preheating current as source power. However, since a portion of the lamp current flows through the control circuit 1210, the control circuit 1210 does not entirely lose source power, and the switches 8, 9 and 15 are maintained in an open state.

Figure 14:
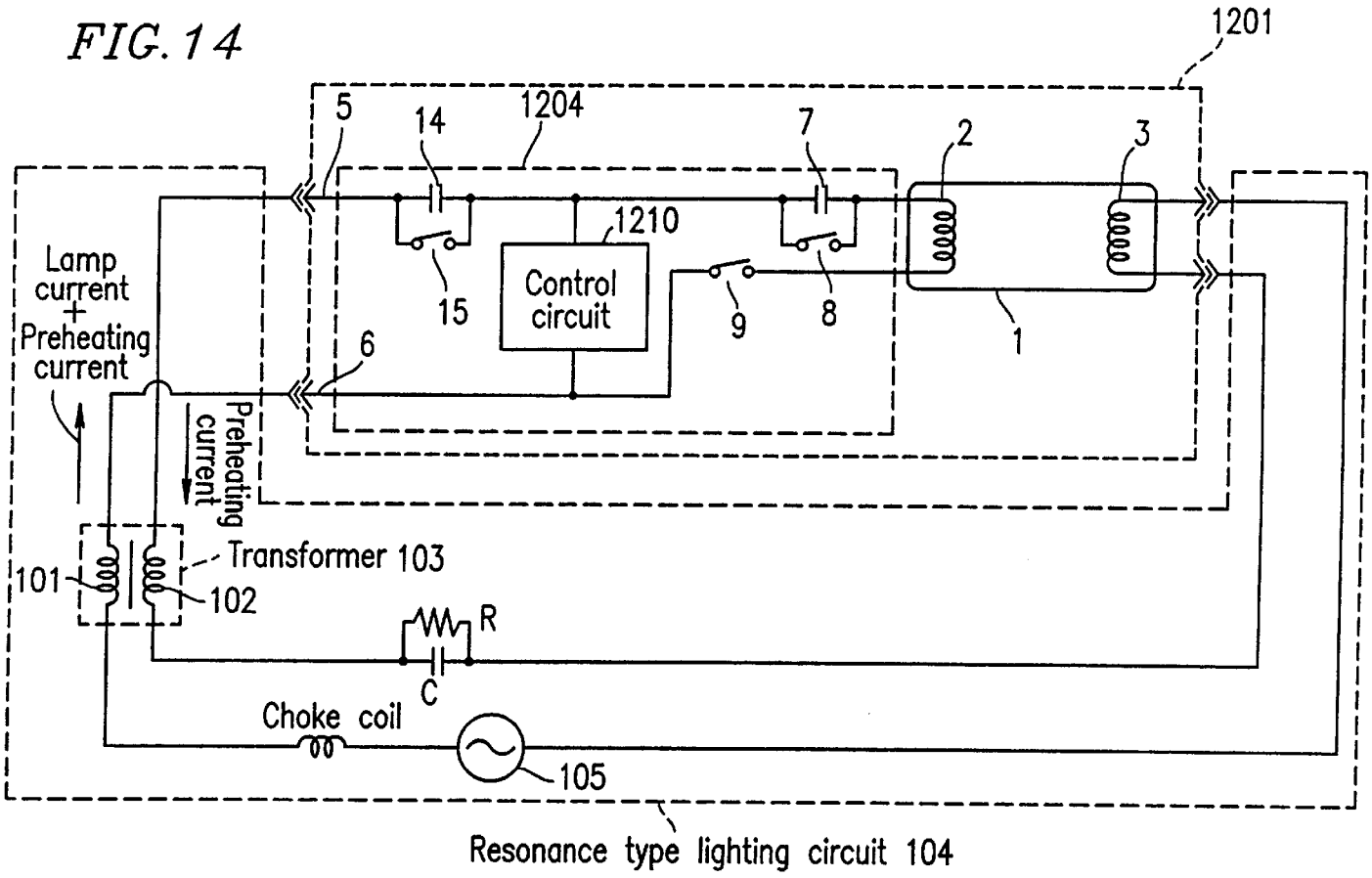
FIG. 14 is a circuit diagram illustrating a state in which a fluorescent lamp 1201 is coupled to a resonance type lighting circuit 104.

FIG. 14 is a circuit diagram illustrating a state in which the fluorescent lamp 1201 is coupled to a resonance type lighting circuit 104. In FIG. 14, constituent elements which also appear in FIGS. 12 and 9 are denoted by the same reference numerals as those used therein, and the associated description is omitted.

Figure 15:
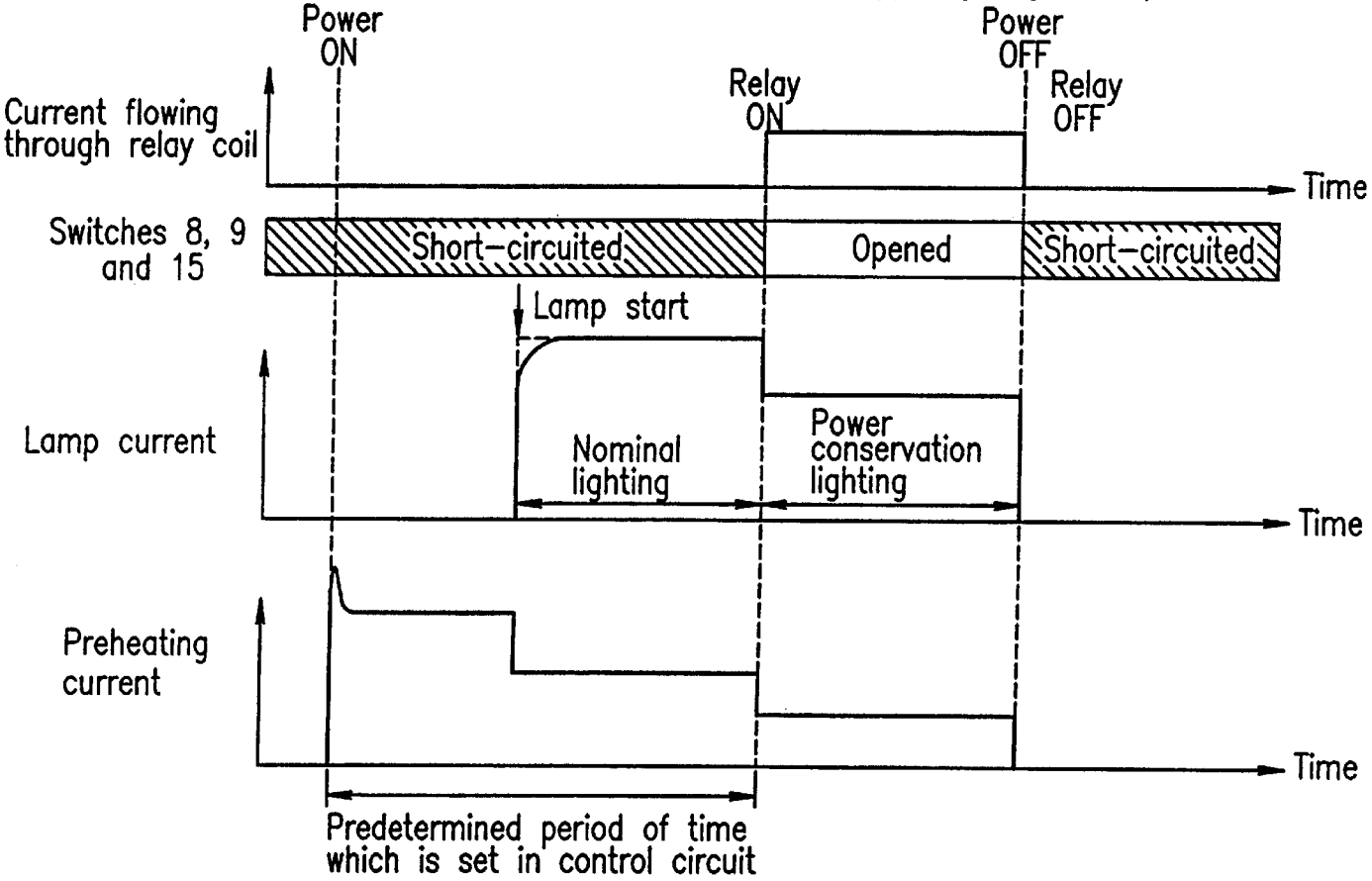
FIG. 15 is a timing diagram illustrating the operation of a switch 8, a switch 9, and a switch 15 in the case where a fluorescent lamp 1201 is coupled to a resonance type lighting circuit 104, as well as changes in the values of a lamp current and a preheating current over time.

FIG. 15 is a timing diagram illustrating the operation of the switches 8, 9 and 15 in the case where the fluorescent lamp 1201 is coupled to the resonance type lighting circuit 104, as well as changes in the values of a lamp current and a preheating current over time. During a predetermined period of time since power is supplied, the control circuit 1210 closes the switches 8, 9 and 15. With the switches 8, 9 and 15 being closed, the fluorescent lamp 1201 can be easily started ("lamp start") as is the case with the operation of the fluorescent lamp 601 described with reference to FIG. 10.

Once the fluorescent lamp 1201 is lit, the lamp current flows through the electrode pin 6, the switch 9, the filament 2, and the filament 3. The preheating current flows through the electrode pin 5, the switch 15, the switch 8, the filament 2, the switch 9, and the electrode pin 6. Since the lamp current and the preheating current are not reduced, a nominal level of lamp current flows ("nominal lighting period"). In the case where a product which is equivalent to FLR40S/M-X is used as the fluorescent lamp 1201, the nominal lamp current level is about 360 mA.

After the lapse of the predetermined period of time since power is supplied, the control circuit 1210 opens the switches 8, 9 and 15. Once the switches 8, 9 and 15 are opened, the preheating current flows through the electrode pin 6, the control circuit 1210, the capacitor 14, and the electrode pin 5. As a result, the preheating current is reduced by means of the capacitor 14 as compared with the preheating current during the nominal lighting period. The lamp current flows through the electrode pin 6, the control circuit 1210, the capacitor 7, the filament 2, and the filament 3.

Thus, although the impedance of the control circuit 1210 and the capacitor 7 is inserted into the current path for the lamp current, the lamp current is not reduced by means of the impedance of the control circuit 1210 and the capacitor 7 because, as mentioned above, the transformer 103 acts to maintain the lamp current at a constant level. However, during the power conservation lighting period, the preheating current is reduced so that the impedance of the transformer 103 increases, whereby the lamp current is reduced. Thus, the power consumption by the fluorescent lamp 1201 is reduced.

During the power conservation lighting period, the preheating current is reduced by means of the preheating current control capacitor 14, so that the control circuit 1210 cannot utilize the preheating current as source power. However, since the lamp current flows through the control circuit 1210, the control circuit 1210 does not entirely lose source power, and the switches 8, 9 and 15 are maintained in an open state.

Table 1 illustrates electro-luminous characteristics which can be obtained in the case where the fluorescent lamp 1201 is coupled to the lead-peak type lighting circuit 114 or the resonance type lighting circuit 104. In the example illustrated in Table 1, the fluorescent lamp 1201 is designed so that the power consumption during the power conservation lighting period is reduced by 20% as compared to the power consumption during the nominal lighting period. The capacitor 7 has a capacitance of about 24 $\mu$F. The capacitance value of the capacitor 14 is prescribed to be a very small value so that the preheating current during the power conservation lighting period can be substantially interrupted.

In Table 1, the values in the luminous flux column are represented in relative values that are taken against the luminous flux generated by the emission tube 1 when the power-conservation function is OFF, i.e., not activated ("nominal lighting period"), which is defined as "1".

TABLE 1

| | | system power | lamp current | luminous flux |
|---|---|---|---|---|
| Lead-peak type lighting circuit | power conservation is OFF | 44.0 W | 0.36 A | 1.00 |
| | power conservation is ON | 36.6 W | 0.27 A | 0.86 |
| Resonance type lighting circuit | power conservation is OFF | 47.3 W | 0.37 A | 1.00 |
| | power conservation is ON | 38.4 W | 0.27 A | 0.84 |

The switches 8, 9 and 15 and the first current regulation means 7, the second current regulation means 14 and the control circuit 1210 shown in FIG. 12 can all be constructed without employing a transformer. Therefore, the power conservation circuit 1204 can be constructed with such a small size and mass that it can be incorporated within the base of the fluorescent lamp 1201. Accordingly, the power-conserving type fluorescent lamp 1201 according to the present example of the invention can simply be used to replace a conventional fluorescent lamp to realize a reduction in the power consumption.

EXAMPLE 4

Each of the power-conservation lighting circuits described in Examples 1 to 3 is incorporated in a fluorescent lamp. According to Example 4, a power converter having a power-conservation lighting circuit therein will be described. In use, such a power converter may be mounted to a conventional fluorescent lamp or an illumination device to obtain effects similar to those described in Examples 1 to 3.

Figure 16:
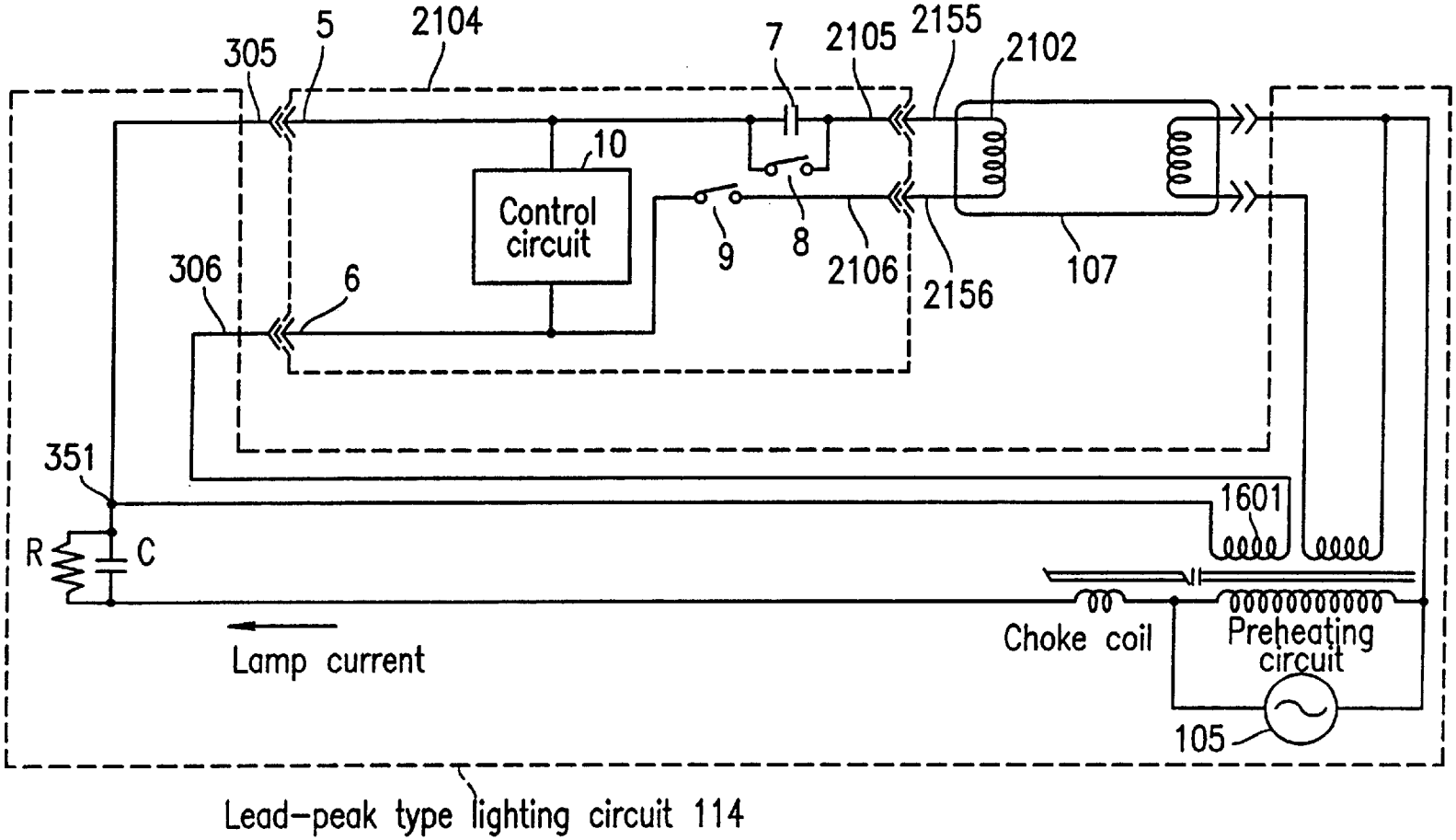
FIG. 16 is a circuit diagram of a power converter 2104.

FIG. 16 is a circuit diagram of a power converter 2104. FIG. 16 illustrates a state in which a conventional fluorescent lamp 107 is coupled to a lead-peak type lighting circuit 114 via the power converter 2104. In FIG. 16, constituent elements which also appear in FIG. 2 are denoted by the same reference numerals as those used therein, and the associated description is omitted.

The power converter 2104 includes: an electrode pin 5 (referred to as a "first electrode pin"); an electrode pin 6 (referred to as a "second electrode pin"); an electrical contact 2105 (referred to as a "first electrical contact"); an electrical contact 2106 (referred to as a "second electrical contact"); a capacitor 7 (referred to as a "current regulation means") coupled between the electrode pin 5 and the electrical contact 2105; a switch 8 coupled in parallel to the capacitor 7; a switch 9 coupled between the electrode pin 6 and the electrical contact 2106; and a control circuit 10 coupled between the electrode pin 5 and the electrode pin 6.

The electrode pin 5 and the electrode pin 6 can be electrically connected to electrical contacts 305 and 306, respectively, of the lead-peak type lighting circuit 114. The electrical contact 2105 and the electrical contact 2106 can be electrically connected to an electrode pin 2155 and an electrode pin 2156, respectively, of a filament 2102 of the fluorescent lamp 107.

The power converter 2104 and the fluorescent lamp 107 together have the same structure as that of the fluorescent lamp 301 (FIG. 2) according to Example 1. Hence, as a whole, the power converter 2104 and the fluorescent lamp 107 operate in the same manner as the fluorescent lamp 301.

Figures 17A, 17B, 17C, 17D, 17E:
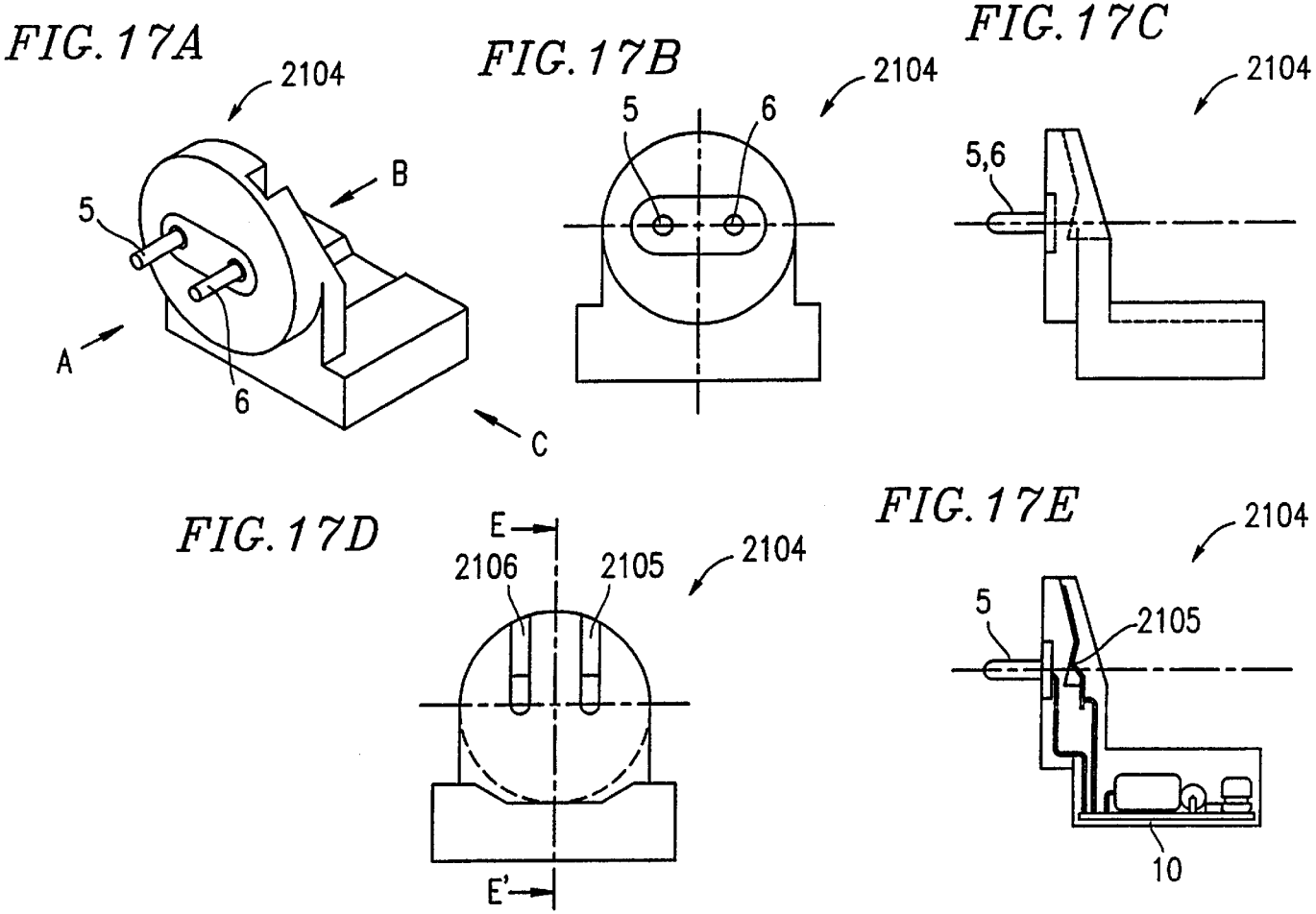
FIGS. 17A, 17B, 17C, 17D, and 17E are various views illustrating a structure of a power converter 2104.

FIGS. 17A, 17B, 17C, 17D, and 17E are various views illustrating a structure of the power converter 2104. FIG. 17A is a perspective view of the power converter 2104. FIG. 17B is a view obtained by viewing the power converter 2104 from direction A shown in FIG. 17A. FIG. 17C is a view obtained by viewing the power converter 2104 from direction C shown in FIG. 17A. FIG. 17D is a view obtained by viewing the power converter 2104 from direction B shown in FIG. 17A. FIG. 17E is a cross-sectional view taken at line E—E in FIG. 17D.

The length of the electrode pins 5 and 6 and the space therebetween are designed so as to be equal to those associated with the electrode pins 2155 and 2156 in the conventional fluorescent lamp 107 (FIG. 16). Similarly, the space between the electrical contacts 2105 and 2106 is designed so as to be equal to that between the electrode pins 2155 and 2156 of the fluorescent lamp 107.

Figure 18:
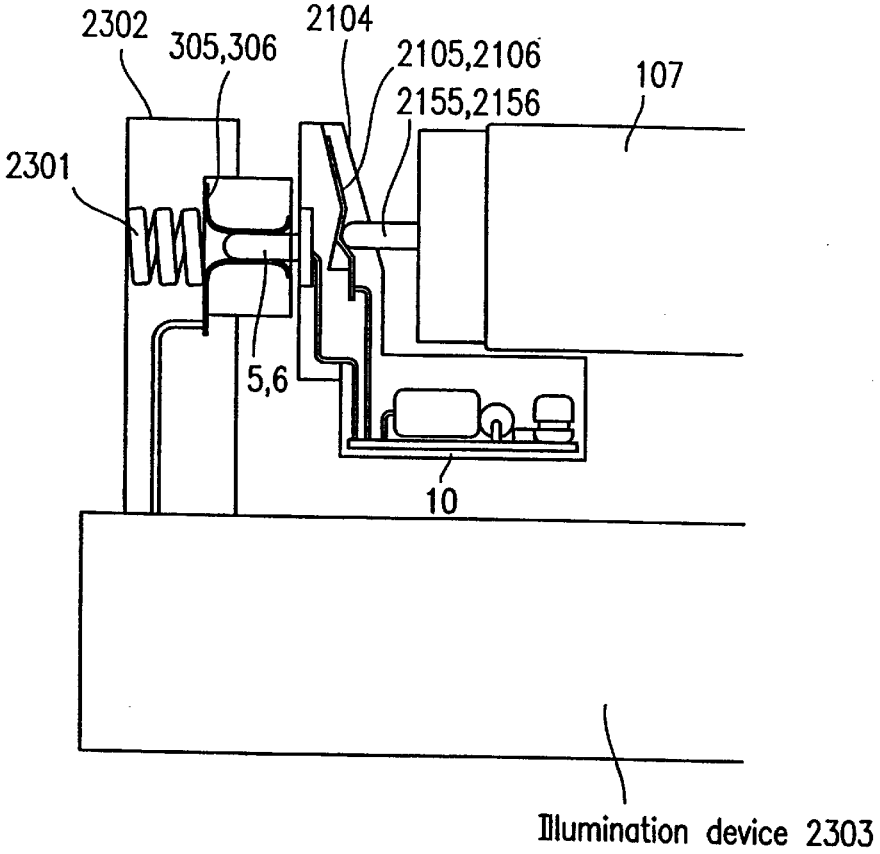
FIG. 18 is a view illustrating a state in which a fluorescent lamp 107 is mounted to an illumination device 2303 via a power converter 2104.

FIG. 18 is a view illustrating a state in which the fluorescent lamp 107 is mounted to an illumination device 2303 via the power converter 2104. The illumination device 2303 may be, for example, an FLR40 type rapid-start type fluorescent lamp illumination device. The illumination device 2303 incorporates, for example, a lead-peak type lighting circuit 114 (not shown in FIG. 18; see FIG. 16).

Figure 19:
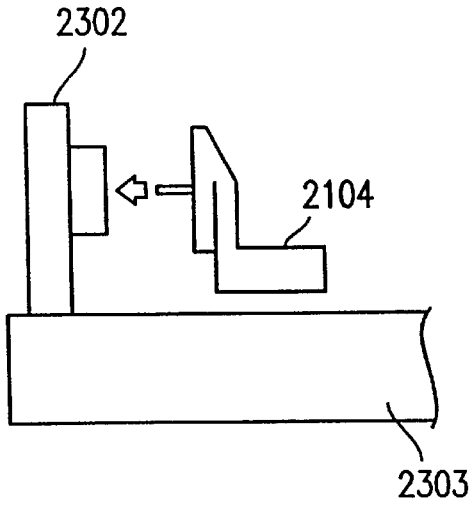
FIG. 19 includes a pair of diagrams illustrating a procedure of mounting a fluorescent lamp 107 to an illumination device 2303 via a power converter 2104.
Figure 19:
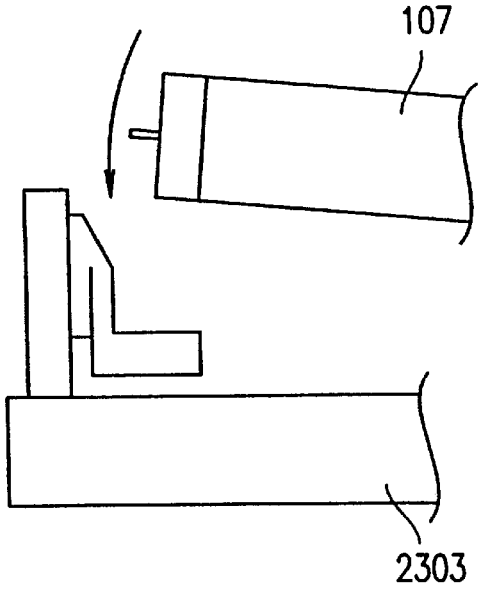

FIG. 19 illustrates a procedure of mounting the fluorescent lamp 107 to the illumination device 2303 via the power converter 2104. When the fluorescent lamp 107 is to be mounted to the illumination device 2303 via the power converter 2104, the power converter 2104 is mounted to the illumination device 2303 first (①). As a result, the electrode pins 5 and 6 are electrically connected to the two electrical contacts 305 and 306, respectively, of a socket 2302 of the illumination device 2303.

Next, the fluorescent lamp 107 is mounted to the illumination device 2303. This may be accomplished by first fitting one end of the fluorescent lamp 107 into a socket (not shown) which is located at the opposite end from the socket 2302 to which the power converter 2104 is attached, and then forcing the other end of the fluorescent lamp 107 against the power converter 2104 (②); as a result, the other end of the fluorescent lamp 107 can be fitted into the power converter 2104 by the action of a spring 2301 provided within the socket 2302 (FIG. 18).

In the example illustrated in FIG. 18, a portion of the power converter 2104 in which the control circuit 10 is accommodated is located in such a position that the portion is interposed between the fluorescent lamp 107 and the illumination device 2303 when the power converter 2104 is mounted to the illumination device 2303. However, the power converter 2104 is not limited to such a configuration.

FIGS. 20A, 20B, 20C, and 20D are various views illustrating another configuration of the power converter 2104.

Figures 20A, 20B, 20C, 20D:
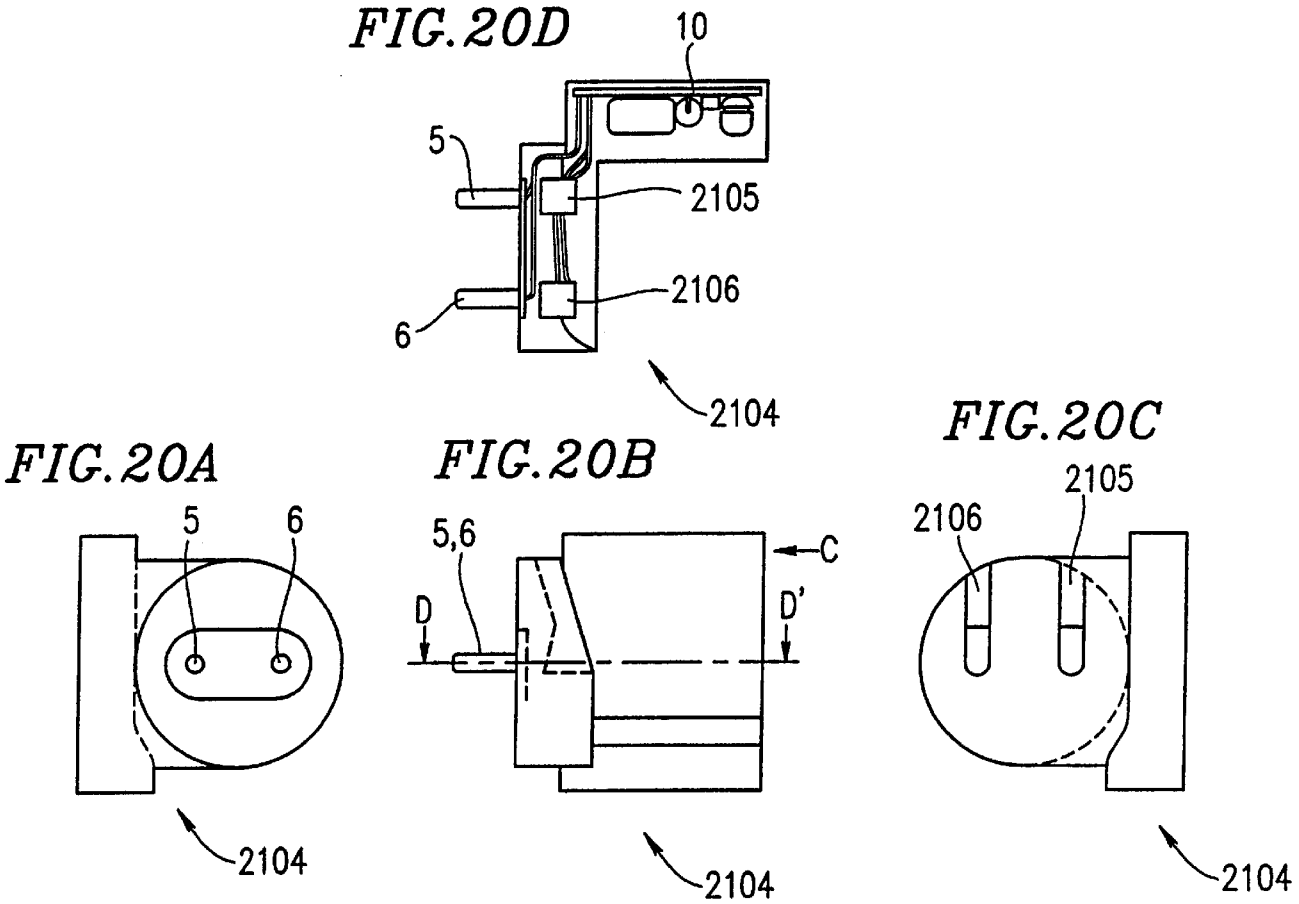
FIGS. 20A, 20B, 20C, and 20D are various views illustrating another configuration of the power converter 2104.

FIG. 20A is a front view of the power converter 2104. FIG. 20B is a side view of the power converter 2104. FIG. 20C is a view obtained by viewing the power converter 2104 from direction C shown in FIG. 20B. FIG. 20D is a cross-sectional view taken at line D–D' in FIG. 20B.

The internal circuitry of the power converter 2104 is not limited to the circuit shown in FIG. 16. As the internal circuitry of the power converter 2104, the power conservation circuit 4 shown in FIG. 8, the power conservation circuit 14 shown in FIG. 9, or the power conservation circuit 1204 shown in FIG. 12 may be employed.

In the case where the power conservation circuit 4 shown in FIG. 8 is employed as the internal circuitry of the power converter 2104, similar effects to those provided by the fluorescent lamp 1701 (described with reference to FIG. 8) can be obtained by mounting the conventional fluorescent lamp 107, via the power converter 2104, to an illumination device incorporating the lead-peak type lighting circuit 114.

In the case where the power conservation circuit 14 shown in FIG. 9 is employed as the internal circuitry of the power converter 2104, similar effects to those provided by the fluorescent lamp 601 (described with reference to FIG. 9) can be obtained by mounting the conventional fluorescent lamp 107, via the power converter 2104, to an illumination device incorporating the resonance type lighting circuit 104.

In the case where the power conservation circuit 1204 shown in FIG. 12 is employed as the internal circuitry of the power converter 2104, similar effects to those provided by the fluorescent lamp 1201 (described with reference to FIGS. 12 and 14) can be obtained by mounting the conventional fluorescent lamp 107, via the power converter 2104, to an illumination device incorporating the lead-peak type lighting circuit 114 or the resonance type lighting circuit 104.

Instead of the control circuit 10 within the power converter 2104, the control circuit 10*a* shown in FIG. 6 may be employed.

Figure 21A:
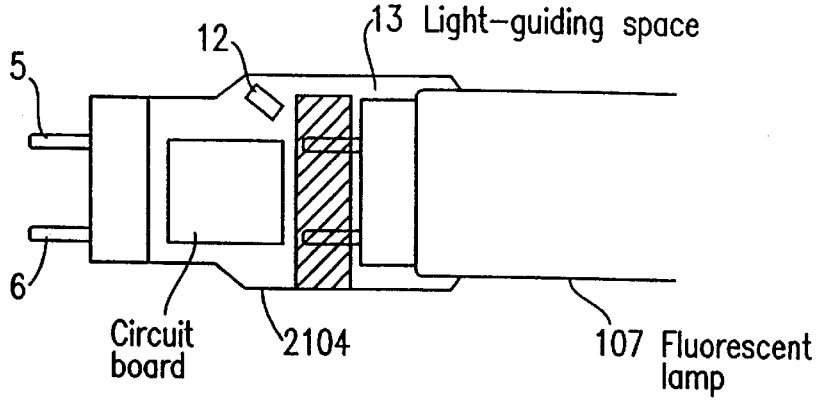
FIG. 21A is a view illustrating still another configuration of the power converter 2104.

FIG. 21A is a view illustrating still another configuration of the power converter 2104. The configuration shown in FIG. 21A is especially preferable in the case where the control circuit 10*a* is employed instead of the control circuit 10 within the power converter 2104. In accordance with the configuration illustrated in FIG. 21A, the power converter 2104 has a light guiding space 13 for guiding the luminous flux generated by an emission tube in the fluorescent lamp 107 to an optical sensor 12. Alternatively, an optical fiber may be employed for guiding the luminous flux generated by the emission tube in the fluorescent lamp 107 to the optical sensor 12.

Figure 21B:
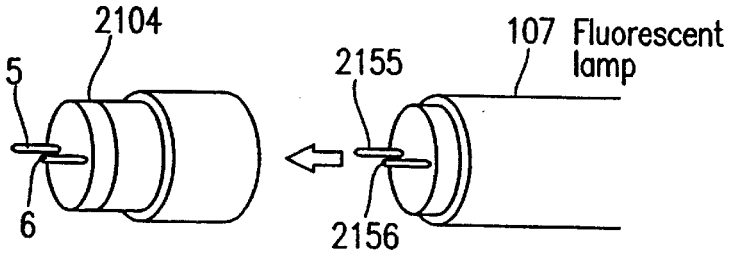
FIG. 21B is a perspective view illustrating how the power converter 2104 shown in FIG. 21A can be mounted to a fluorescent lamp 107.

FIG. 21B is a perspective view illustrating how the power converter 2104 shown in FIG. 21A can be mounted to a fluorescent lamp 107. As shown in FIG. 21B, the power converter 2104 is fitted in one end of the fluorescent lamp 107. The fluorescent lamp 107 in which the power converter 2104 has been fitted can be mounted to an illumination device and be lit with a relatively low power consumption.

As described above, the power converter 2104 according to Example 4 includes: the first electrode pin 5 and the second electrode pin 6, which are adapted so as to be capable of being electrically connected to the two electrical contacts 305 and 306, respectively, of the socket 2302 of the rapid-start type fluorescent lamp illumination device 2303; and the first electrical contact 2105 and the second electrical contact 2106, which are adapted so as to be capable of being electrically connected to the two electrode pins 2155 and 2156, respectively, of the filament 2102 of the fluorescent lamp 107 mounted to the fluorescent lamp illumination device 2303. Therefore, the power converter 2104 according to Example 4 can be easily mounted to an illumination device or a fluorescent lamp.

EXAMPLE 5

The power converter described in Example 4 is mounted to a conventional fluorescent lamp or an illumination device. According to Example 5, a power converter which is incorporated in an illumination device will be described.

Figure 22:
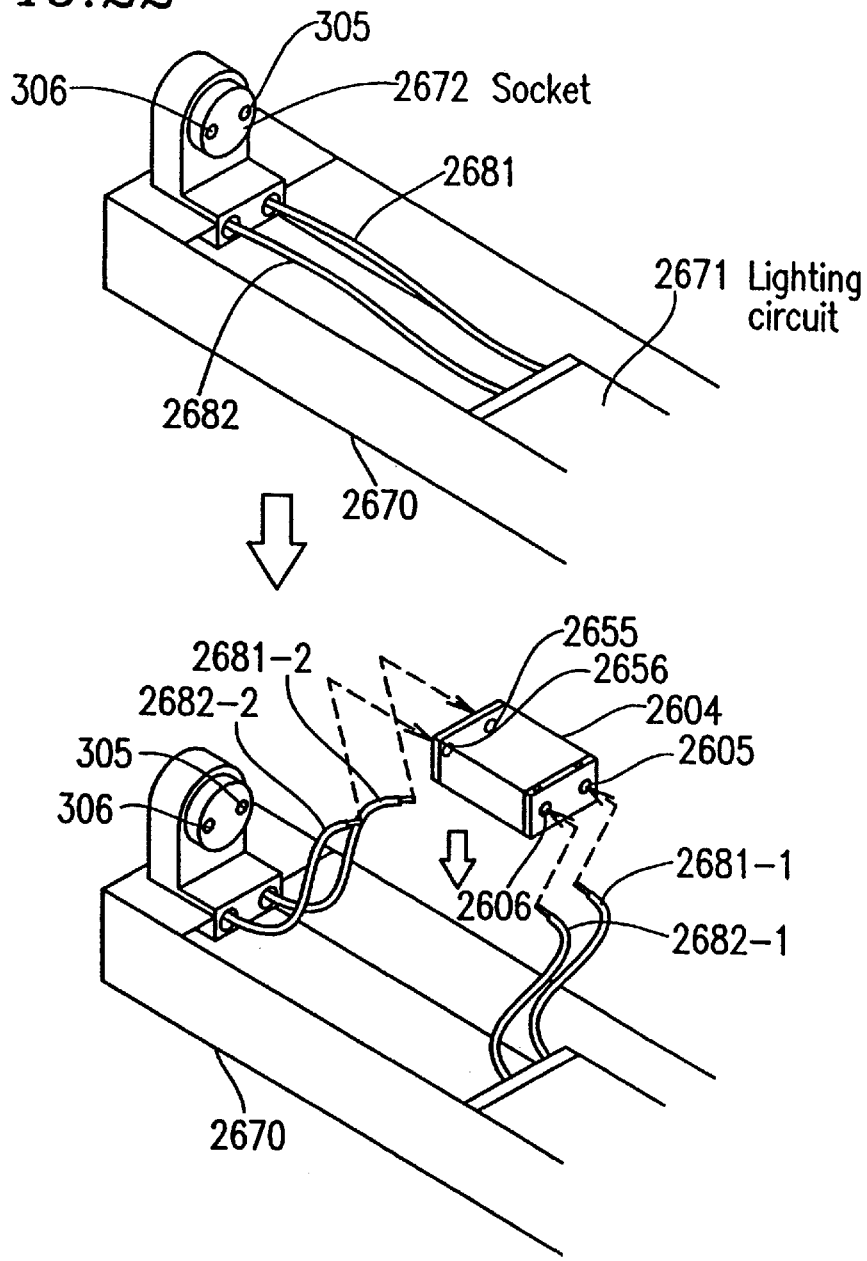
FIG. 22 includes a pair of perspective views illustrating a procedure of mounting a power converter 2604 inside an illumination device 2670.

FIG. 22 illustrates a procedure of mounting a power converter 2604 inside an illumination device 2670. The power converter 2604 may have a structure similar to that of the power converter 2104 (FIG. 16) according to Example 4. However, the power converter 2604 includes an input terminal 2605 (referred to as a "first input terminal") and an input terminal 2606 (referred to as a "second input terminal") instead of the electrode pins 5 and 6 of the power converter 2104. Moreover, the power converter 2604 includes an output terminal 2655 (referred to as a "first output terminal") and an output terminal 2656 (referred to as a "second output terminal") instead of the electrical contacts 2105 and 2106 of the power converter 2104.

The rapid-start type fluorescent lamp illumination device 2670 includes a lighting circuit 2671 and a socket 2672. The lighting circuit 2671 may be a lead-peak type lighting circuit or a resonance type lighting circuit. The power converter 2604 is inserted in two wires 2681 and 2682, which extend from the lighting circuit 2671 to the socket 2672. Specifically, the wire 2681 is cut into a wire section 2681-1 (i.e., a portion which is left closer to the lighting circuit) and a wire section 2681-2 (i.e., a portion which is left closer to the socket), and the wire 2682 is cut into a wire section 2682-1 (i.e., a portion which is left closer to the lighting circuit) and a wire section 2682-2 (i.e., a portion which is left closer to the socket). The wire section 2681-2 and the wire section 2682-2 are respectively coupled to electrical contacts 305 and 306 in the socket 2672. Next, the wire section 2681-1 is coupled to the input terminal 2605, and the wire section 2682-1 is coupled to the input terminal 2606. The wire section 2681-2 is coupled to the output terminal 2655, and the wire 2682-2 is coupled to the output terminal 2656.

Figure 23:
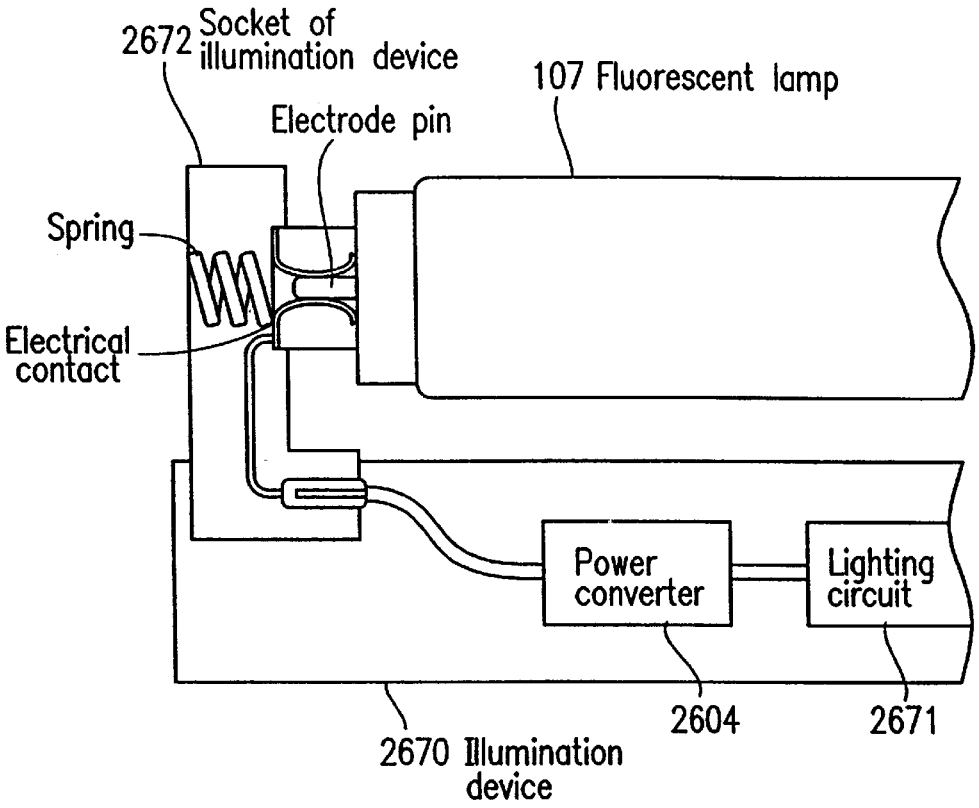
FIG. 23 is a view illustrating a state in which a conventional fluorescent lamp 107 has been mounted in an illumination device 2670 incorporating a power converter 2604.

FIG. 23 is a view illustrating a state in which a conventional fluorescent lamp 107 has been mounted in the illumination device 2670 incorporating the power converter 2604. Since the power converter 2604 is incorporated in the illumination device 2670, the conventional fluorescent lamp 107 can be lit with a relatively low power consumption. Thus, since the power converter 2604 is disposed within the interior of the illumination device 2670, the appearance of the illumination device 2670 is not changed, so that no aesthetic damage results in the illumination device 2670.

As the internal circuitry of the power converter 2604, the power conservation circuit 4 shown in FIG. 8, the power conservation circuit 14 shown in FIG. 9, or the power conservation circuit 1204 shown in FIG. 12 may be employed. Instead of the control circuit 10 within the power converter 2604, the control circuit 10*a* shown in FIG. 6 may be employed.

The power converter 2604 may be formed as an integral part of the socket 2672.

Figure 24:
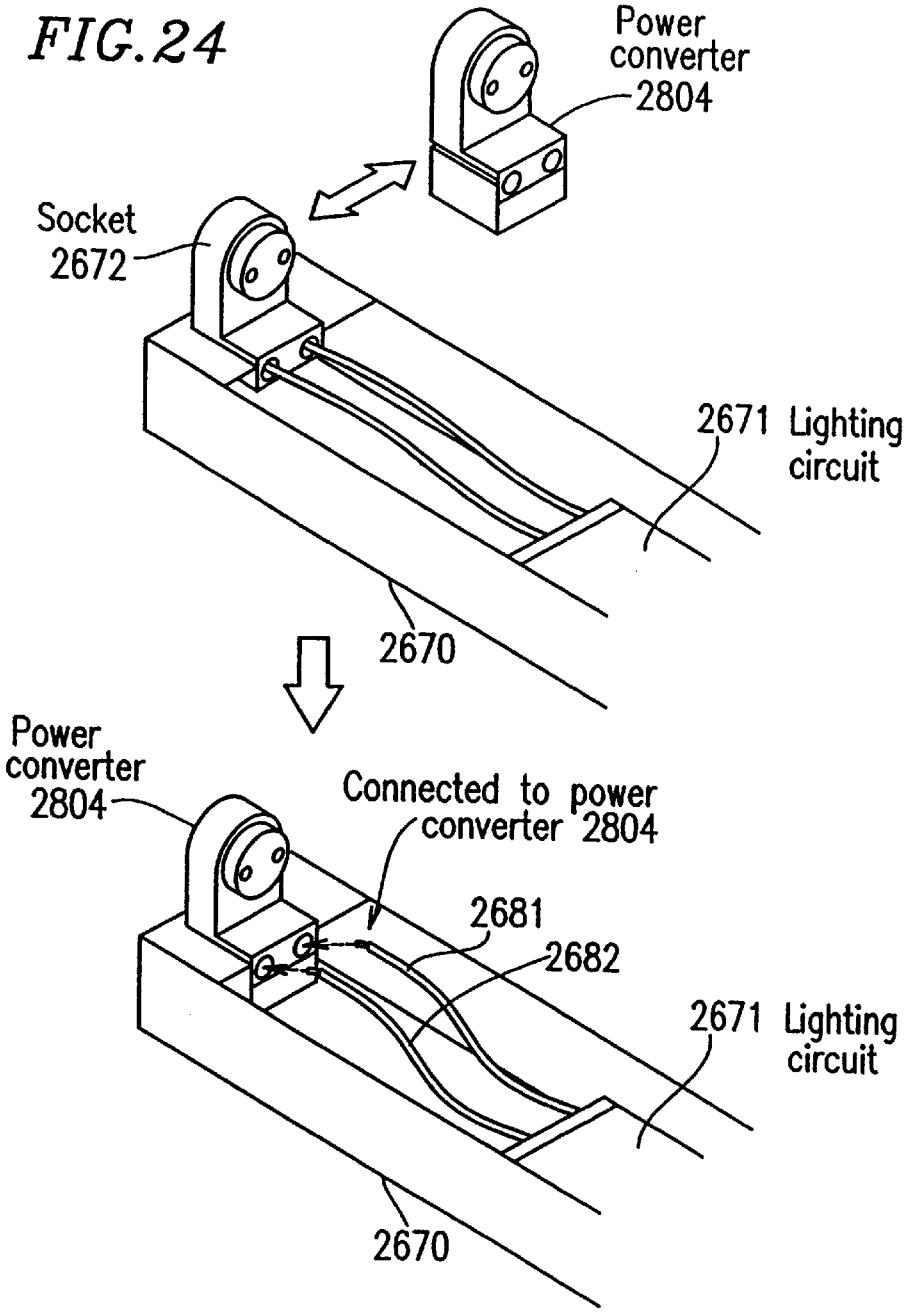
FIG. 24 includes a pair of perspective views illustrating a power converter 2804 which is formed as an integral part of a socket.

FIG. 24 includes a pair of perspective views illustrating a power converter 2804 which is formed as an integral part of a socket. In FIG. 24, constituent elements which also appear in FIG. 22 are denoted by the same reference numerals as those used therein, and the associated description is omitted.

The power converter 2804 can be used to replace the socket 2672 of the illumination device 2670, as a result of which the power converter 2804 is incorporated in the interior of the illumination device 2670. The power converter 2804 may have a structure similar to that of the power converter 2604 illustrated with reference to FIGS. 22 and 23.

Figure 25:
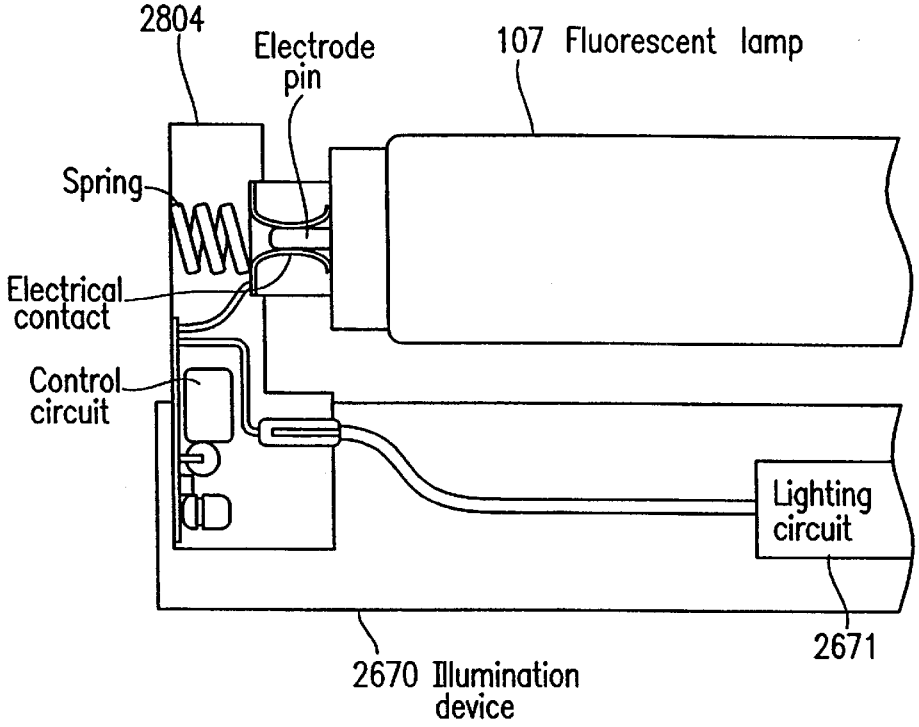
FIG. 25 is a view illustrating a state in which a conventional fluorescent lamp 107 has been mounted in an illumination device 2670 incorporating a power converter 2804.
Figure 26:
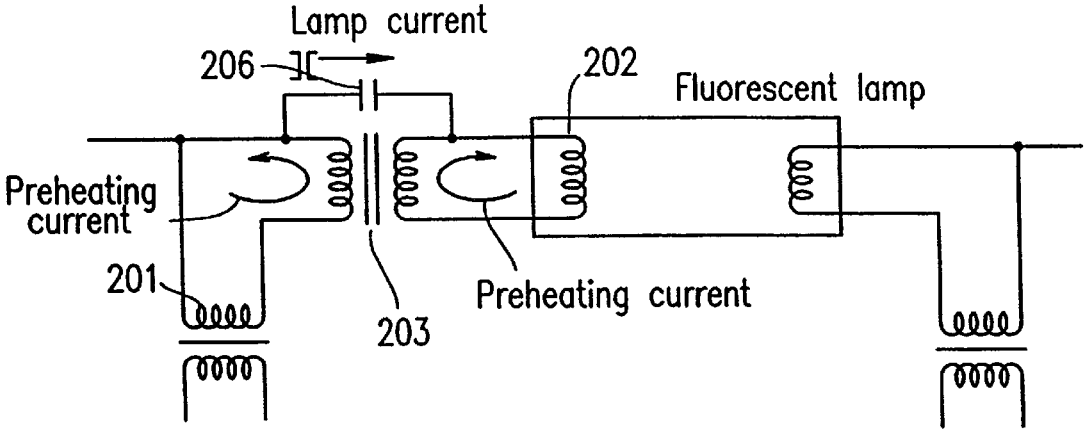
FIG. 26 RELATED ART
FIG. 26 is a circuit diagram illustrating the principles by which a fluorescent lamp can be lit with a relatively low power consumption according to the Sylvania method.

FIG. 25 is a view illustrating a state in which a conventional fluorescent lamp 107 has been mounted in the illumination device 2670 incorporating the power converter 2804. By incorporating the power converter 2804 in the illumination device 2670, the conventional fluorescent lamp 107 can be lit with a relatively low power consumption. Thus, since the power converter 2804 is disposed within the interior of the illumination device 2670, the appearance of the illumination device 2670 is not changed, so that no aesthetic damage results in the illumination device 2670.

As the internal circuitry of the power converter 2804, the power conservation circuit 4 shown in FIG. 8, the power conservation circuit 14 shown in FIG. 9, or the power conservation circuit 1204 shown in FIG. 12 may be employed. Instead of the control circuit 10 within the power converter 2804, the control circuit 10*a* shown in FIG. 6 may be employed.

As described above, by employing the power converter 2104 (FIG. 16) according to Example 4, or the power converter 2604 (FIG. 22) or the power converter 2804 (FIG. 24) according to Example 5, a conventional fluorescent lamp 107 can be lit with a relatively low power consumption. The power converter can be continuously used even after the life of the fluorescent lamp 107 expires so long as the power converter is designed so as to have a sufficiently long circuit life. As a result, the running cost can be reduced as compared to the case where the power conservation circuit is incorporated within a fluorescent lamp as in Examples 1 to 3.

In all of the aforementioned examples, the fluorescent lamp operates in a power-conservation mode during the power conservation lighting period. A display means for indicating whether or not the fluorescent lamp is operating in the power-conservation mode may be provided in the fluorescent lamp or the power converter. Such a display means may be, for example, a light emitting device. The light emitting device 381 shown in FIG. 2 functions as such a display means. The light emitting device 381 is driven by the control circuit 10. The light emitting device 381 may be arranged so as to be turned ON or OFF during the power conservation lighting period. The light emitting device 381 is preferably disposed in a position where it can be easily seen by a user when the fluorescent lamp 301 is mounted to an illumination device. The light emitting device 381 may be disposed in a base of the fluorescent lamp 301, for example. The light emitting device 381 allows a user to recognize whether or not the fluorescent lamp 301 is operating in a power-conservation mode.

In all of the aforementioned examples, a means may be provided for selectively enabling or disabling the reduction in the lamp current during the power conservation lighting period. Such a means may be realized by a switch 950 provided in the control circuit 10 (FIG. 3) of the fluorescent lamp 301 according to Example 1. When the switch 950 is opened, no current flows through the relay coil 11, so that the switches 8 and 9 (FIG. 2) are not opened. Thus, by adapting the control circuit 10 so as to be capable of selectively switching the switches 8 and 9 so as to be both opened or closed during the power conservation lighting period, a user of the fluorescent lamp 301 may choose to compromise brightness for low power consumption, or give a higher priority to brightness. The switch 950 may be controlled by means of a remote control. Similarly, by providing a switch 1050 in the control circuit 10*a* (FIG. 6), the control circuit 10*a* may be adapted to be capable of selectively switching the switches 8 and 9 so as to be both opened or closed during the power conservation lighting period.

The fluorescent lamp according to the present invention includes: an emission tube for generating a luminous flux; a first filament provided at one end of the emission tube; a second filament provided at another end of the emission tube; first current regulation means having a first impedance: a first electrode pin coupled to one end of the first filament via the first current regulation means; a first switch coupled in parallel to the first current regulation means; a second switch; a second electrode pin coupled to another end of the first filament via the second switch; and a control circuit for controlling the first switch and the second switch so as to be opened or closed.

The control circuit closes the first switch and the second switch before the fluorescent lamp is lit and during a nominal lighting period after the fluorescent lamp is lit, and opens the first switch and the second switch during a power conservation lighting period following the nominal lighting period.

When the fluorescent lamp according to the present invention is mounted to a lead-peak type lighting circuit, a preheating current is not reduced before the fluorescent lamp is lit, so that the fluorescent lamp can be easily started. During the power conservation lighting period, a lamp current flows through the first current regulation means having the first impedance, so that the lamp current is reduced as compared to the case where the lamp current flows without passing through the first current regulation means (i.e., during the nominal lighting period). As a result, the fluorescent lamp can be lit with a relatively low power consumption.

As described above, these constituent elements can be constructed with a small size and mass without employing transformers. Thus, there is provided a power-conserving type fluorescent lamp such that a reduction in the power consumption can be achieved by simply replacing a conventional fluorescent lamp with the power-conserving type fluorescent lamp according to the present invention.

The fluorescent lamp according to the present invention may further include second current regulation means having a second impedance, and a third switch coupled in parallel to the second current regulation means. The control circuit is coupled to the first electrode pin via the second current regulation means, such that the control circuit opens the third switch during the power conservation lighting period.

When the fluorescent lamp according to the present invention is mounted to a resonance type lighting circuit, the preheating current is not reduced before the fluorescent lamp is lit, so that the fluorescent lamp can be easily started. During the power conservation lighting period, the preheating current flows through the second current regulation means having the second impedance, so that the preheating current can be reduced as compared to the case where the preheating current flows without passing through the second current regulation means (i.e., during the nominal lighting period). In the case where the fluorescent lamp according to the present invention is mounted to a resonance type lighting circuit, a reduction in the preheating current also calls for a reduction in the lamp current. Thus, the fluorescent lamp can be lit with a relatively low power consumption. Accordingly, there is provided a fluorescent lamp which can be adapted to both a resonance type lighting circuit and a lead-peak type lighting circuit, and which can simply be used to replace a conventional fluorescent lamp to achieve a reduction in power consumption.

A power converter according to the present invention includes a first electrode pin and a second electrode pin which are adapted so as to be capable of being electrically connected to two electrical contacts of a socket of a rapid-start type fluorescent lamp illumination device, and a first electrical contact and a second electrical contact which are adapted so as to be capable of being electrically connected to two electrode pins of a filament of a fluorescent lamp to be mounted to the fluorescent lamp illumination device. Thus, the power converter according to the present invention can be easily mounted to an illumination device or a fluorescent lamp.

The power converter according to the present invention includes: current regulation means having an impedance and coupled between the first electrode pin and the first electrical contact; a first switch coupled in parallel to the current regulation means; a second switch coupled between the second electrode pin and the second electrical contact; and a control circuit for controlling the first switch and the second switch so as to be opened or closed, such that the control circuit closes the first switch and the second switch before the fluorescent lamp is lit and during a nominal lighting period after the fluorescent lamp is lit, and opens the first switch and the second switch during a power conservation lighting period following the nominal lighting period.

When a conventional fluorescent lamp is mounted to an illumination device having a rapid-start type ballast via such a power converter, the preheating current is not reduced before the fluorescent lamp is lit, so that the fluorescent lamp can be easily started. During a power conservation lighting period, a lamp current flows through the current regulation means having an impedance, so that the lamp current can be reduced as compared to the case where the lamp current flows without passing through the current regulation means (i.e., during a nominal lighting period). Thus, the power consumption of the fluorescent lamp can be reduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A fluorescent lamp comprising:

an emission tube for generating a luminous flux;

a first filament provided at one end of the emission tube;

a second filament provided at another end of the emission tube;

first current regulation means having a first impedance;

a first electrode pin coupled to one end of the first filament via the first current regulation means;

a first switch coupled in parallel to the first current regulation means;

a second switch;

a second electrode pin coupled to another end of the first filament via the second switch; and a control circuit for controlling the first switch and the second switch so as to be opened or closed, wherein the control circuit closes the first switch and the second switch before the fluorescent lamp is lit and during a nominal lighting period after the fluorescent lamp is lit, and opens the first switch and the second switch during a power conservation lighting period following the nominal lighting period.

2. A fluorescent lamp according to claim 1, wherein the control circuit opens the first switch and the second switch after a predetermined period has elapsed since a current flows between the first electrode pin and the second electrode pin.

3. A fluorescent lamp according to claim 1, wherein:

the control circuit includes luminous flux detection means for detecting the luminous flux; and the control circuit opens the first switch and the second switch when the luminous flux detected by the luminous flux detection means exceeds a predetermined value.

4. A fluorescent lamp according to claim 1, wherein the first current regulation means comprises at least one element selected from the group consisting of a capacitor, a resistor, a coil and a thyristor.

5. A fluorescent lamp according to claim 1, further comprising display means for displaying whether or not the fluorescent lamp is operating in a power-conservation lighting mode.

6. A fluorescent lamp according to claim 1, wherein:

the fluorescent lamp further comprises second current regulation means having a second impedance, and a third switch coupled in parallel to the second current regulation means;

the control circuit is coupled to the first electrode pin via the second current regulation means; and the control circuit opens the third switch during the power conservation lighting period.

7. A fluorescent lamp comprising:

an emission tube for generating a luminous flux;

a first filament provided at one end of the emission tube;

a second filament provided at another end of the emission tube;

first current regulation means having a first impedance;

a first electrode pin coupled to one end of the first filament via the first current regulation means;

a first switch coupled in parallel to the first current regulation means;

a second switch;

a second electrode pin coupled to another end of the first filament via the second switch; and a control circuit for controlling the first switch and the second switch so as to be opened or closed, wherein the control circuit closes the first switch and the second switch before the fluorescent lamp is lit and during a nominal lighting period after the fluorescent lamp is lit, and is configured to switch the first switch and the second switch so as the first and second switches are both opened or closed during a power conservation lighting period following the nominal lighting period.

8. A power converter comprising:

a first electrode pin and a second electrode pin which are configured so as to be capable of being electrically connected to two electrical contacts of a socket of a rapid-start type fluorescent lamp illumination device;

a first electrical contact and a second electrical contact which are configured so as to be capable of being electrically connected to two electrode pins of a filament of a fluorescent lamp to be mounted to the fluorescent lamp illumination device;

current regulation means having an impedance and coupled between the first electrode pin and the first electrical contact;

a first switch coupled in parallel to the current regulation means;

a second switch coupled between the second electrode pin and the second electrical contact; and a control circuit for controlling the first switch and the second switch so as to be opened or closed, wherein the control circuit closes the first switch and the second switch before the fluorescent lamp is lit and during a nominal lighting period after The fluorescent lamp is lit, and opens the first switch and the second switch during a power conservation lighting period following the nominal lighting period.

9. A power converter comprising:

a first input terminal and a second input terminal which are configured so as to be capable of being electrically connected to two wires extending from a lighting circuit to a socket in a rapid-start type fluorescent lamp illumination device for lighting a fluorescent lamp;

a first output terminal and a second output terminal which are configured so as to be capable of being electrically connected to two wires in electrical connection with electrical contacts of the socket;

current regulation means having an impedance and coupled between the first input terminal and the first output terminal;

a first switch coupled in parallel to the current regulation means;

a second switch coupled between the second input terminal and the second output terminal; and a control circuit for controlling the first switch and the second switch so as to be opened or closed, wherein the control circuit closes the first switch and the second switch before the fluorescent lamp is lit and during a nominal lighting period after the fluorescent lamp is lit, and opens the first switch and the second switch during a power conservation lighting period following the nominal lighting period.

* * * * *

UNITED STATES PATENT AND TRADEMARK OFFICE

CERTIFICATE OF CORRECTION

PATENT NO. : 6,570,342 B2
DATED : May 27, 2003
INVENTOR(S) : Kazuaki Okubo et al.

It is certified that error appears in the above-identified patent and that said Letters Patent is hereby corrected as shown below:

Title page,
Item [57], ABSTRACT,
Line 11, "doses" should be -- closes --.

Column 25,
Line 13, "The" should be -- the --.

Signed and Sealed this

Nineteenth Day of August, 2003

JAMES E. ROGAN
*Director of the United States Patent and Trademark Office*